US007762311B2

(12) United States Patent
Kubota et al.

(10) Patent No.: US 7,762,311 B2
(45) Date of Patent: Jul. 27, 2010

(54) METHOD FOR CONTROLLING FLOW OF MOLTEN STEEL IN MOLD AND METHOD FOR CONTINUOUSLY PRODUCING A CAST PRODUCT

(75) Inventors: Jun Kubota, Chiba (JP); Seishl Mizuoka, Tokyo (JP); Tsuneo Kondo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 12/381,705

(22) Filed: Mar. 16, 2009

(65) Prior Publication Data

US 2009/0236069 A1 Sep. 24, 2009

Related U.S. Application Data

(62) Division of application No. 10/506,034, filed as application No. PCT/JP03/02301 on Feb. 28, 2003, now Pat. No. 7,540,317.

(30) Foreign Application Priority Data

Mar. 1, 2002 (JP) ..... 2002-055871
Feb. 24, 2003 (JP) ..... 2003-046239

(51) Int. Cl.
*B22D 11/00* (2006.01)
*B22D 27/02* (2006.01)

(52) U.S. Cl. ..... 164/466; 164/468; 164/502; 164/504

(58) Field of Classification Search ..... 164/466, 164/468, 502, 504
See application file for complete search history.

(56) References Cited

U.S. PATENT DOCUMENTS

| | | | | |
|---|---|---|---|---|
| 5,307,863 | A | 5/1994 | Kubota et al. | |
| 5,657,816 | A | 8/1997 | Harada et al. | |
| 5,699,850 | A | 12/1997 | Beitelman et al. | |
| 6,443,219 | B1 | 9/2002 | Sasai et al. | |
| 7,540,317 | B2 * | 6/2009 | Kubota et al. | 164/466 |

FOREIGN PATENT DOCUMENTS

| | | | |
|---|---|---|---|
| EP | 0 707 909 | A1 | 4/1996 |
| JP | 63-16840 | A | 1/1988 |
| JP | 63-16841 | A | 1/1988 |
| JP | 5-329594 | A | 12/1993 |
| JP | 5-329596 | A | 12/1993 |
| JP | 9-182943 | A | 7/1997 |
| JP | 10-193047 | A | 7/1998 |
| JP | 11-239851 | A | 9/1999 |
| JP | 2000-158108 | A | 6/2000 |
| JP | 2000-351048 | A | 12/2000 |

* cited by examiner

*Primary Examiner*—Kevin P Kerns
(74) *Attorney, Agent, or Firm*—Frishauf, Holtz, Goodman & Chick, P.C.

(57) ABSTRACT

A method for controlling a flow of molten steel in a slab continuous casting machine including controlling a molten steel flow velocity on a molten steel bath surface to a predetermined flow velocity by applying a shifting magnetic field; controlling the molten steel flow velocity on the molten steel bath surface from an inclusion-adherence critical flow velocity or more to a mold-powder entrainment critical flow velocity or less by applying a shifting magnetic field; and controlling the molten steel flow velocity on the molten steel bath surface from the inclusion-adherence critical flow velocity or more to the mold-powder entrainment critical flow velocity or less by applying a shifting magnetic field.

22 Claims, 17 Drawing Sheets

METHOD FOR CONTROLLING FLOW OF MOLTEN STEEL IN MOLD AND METHOD FOR CONTINUOUSLY PRODUCING A CAST PRODUCT

CROSS-REFERENCE TO RELATED APPLICATIONS

This application is a Divisional application of application Ser. No. 10/506,034 filed Oct. 25, 2004, now U.S. Pat. No. 7,540,317 which is a United States national phase application of International application PCT/JP03/02301 filed Feb. 28, 2003. The entire contents of each of application Ser. No. 10/506,034 and application PCT/JP03/02301 are hereby incorporated by reference herein.

FIELD OF THE INVENTION

The present invention relates to a method and an apparatus for controlling a flow of molten steel in a mold using a slab continuous casting machine, and a method for producing a slab using the flow control method and apparatus.

DESCRIPTION OF THE RELATED ARTS

One of quality factors required for a slab (which hereafter will be referred to as a "cast product") to be produced by a slab continuous casting machine is a reduced amount of inclusions entrapped in a surface layer of the cast product. Such inclusions to be entrapped in the cast product surface layer are, for example: (1) deoxidation products occurring in a deoxidation step using Al and the like and suspending in molten steel; (2) Ar gas bubbles blown into molten steel in a tundish or blown through an immersion nozzle; and (3) inclusions occurring with mold powder sprayed on a molten steel bath surface and entrained into the molten steel as suspending substances. Any of these inclusions causes surface defects in steel products, so that it is important to reduce any of the inclusions.

By way of means for reducing, for example, deoxidation products and Ar gas bubbles among the above-described inclusions, there are popularly used processes of the type to prevent entrapment of inclusions in such a manner that intra-mold molten steel is driven to move in the horizontal direction, and a molten steel velocity is thereby imparted to the surface of the molten steel to clean a solidifying surface. A practical process of applying a magnetic field for rotating the intra-mold molten steel in the horizontal direction is carried out in such a manner that the magnetic field moving horizontally along the directions of long sides of the mold is driven to move in the directions opposite to each other along the opposing long-side surfaces to induce a molten steel flow that behaves to rotate in the horizontal direction along the solidified surface. In this document, the application process is referred to as "EMRS," "EMRS mode," or "EMRS-mode magnetic field application" (EMRS: electromagnetic rotative stirring). Examples of the process are described in, for example, Japanese Unexamined Patent Application Publications No. 5-329594 and No. 5-329596.

However, in the EMRS-mode magnetic field application, rotational vortex flow is imparted also to the intra-mold molten steel bath surface. As such, when the casting speed is increased, the flow velocity per se of molten steel to be discharged from the immersion nozzle is increased, and in addition, the flow velocity of molten steel in an intra-mold molten steel bath surface position is increased.

Accordingly, when the magnetic field is applied in the above state according to the EMRS mode, the flow velocity of the molten steel in the intra-mold molten steel bath surface position is further increased. Consequently, a case can occur in which mold-powder entrainment can take place.

The mold-powder entrainment occurs in the event of a high molten steel flow velocity on the intra-mold molten steel bath surface. By way of means for reducing the inclusions, a process is employed in which a shifting magnetic field is applied to impart a braking force to a discharge flow from the immersion nozzle whereby to reduce the molten steel flow velocity of the intra-mold molten steel bath surface. A practical process of applying the magnetic field for imparting the braking force to the discharge flow from the immersion nozzle is carried out as described hereunder. The magnetic field moving horizontally along the direction of the long-side of the mold is driven to move in the direction to the side of immersion nozzle from the side of short side of the mold, that is, in the direction opposite to the discharge direction of the immersion nozzle to thereby induce a molten steel flow that behaves such as imparting the braking force to the molten steel discharge flow. In this document, the application process is referred to as "EMLS," "EMLS mode," or "EMLS-mode magnetic field application" (EMLS: electromagnetic level stabilizer/slowing down). In the event that the magnetic-field is applied according to the EMLS mode, more specifically, even in the event that a molten steel pouring amount per unit time is large, the molten steel flow velocity of the intra-mold molten steel bath surface can be attenuated, so that mold-powder entrainment can be prevented. Examples of this process are described in, for example, Japanese Unexamined Patent Application Publications No. 63-16840 and No. 63-16841.

However, under conditions in which the casting speed is not high and mold-powder entrainment due to molten steel flow of the intra-mold molten steel bath surface does not occur, also the velocity of molten steel flow along the solidifying surface is low. For this reason, when the magnetic field is applied in the state described above, the velocity of the molten steel flow is further reduced. Conventionally, the application has caused cases of facilitating adherence of substances such as deoxidation products and Ar gas bubbles.

As described above, the intra-mold molten steel flow control method according to any one of the conventional EMLS and EMRS modes has the problems that make it difficult to obtain a cast product with high surface quality constantly over a wide range of casting speeds.

The present invention is proposed in view of the circumstances described above, an object of the present invention is to provide an intra-mold molten steel flow control method and intra-mold molten steel flow control apparatus for intra-mold molten steel that enable obtaining high quality cast products containing a reduced amount of inclusions in a cast product surface at any casting speed. Another object of the present invention is to provide a manufacturing method employing the method and the apparatus to manufacture continuous-casting cast products.

SUMMARY OF THE INVENTION

The inventors of the present invention conducted extensive study and research to solve the problems described above. The contents of the study and research are described in detail below.

Firstly, the inventors re-reviewed the conventional problems to describe them. Consequently, the inventors found that the effect of the EMRS-mode magnetic field application decreases on the high side of the casting speed, whereas the effect of the EMLS-mode magnetic field application decreases on the low side of the casting speed.

In this connection, the inventors conducted studies regarding positions of the intra-mold molten steel bath surface at which necessariness or unnecessariness of the application of a shifting magnetic field against the phenomenon of the intra-mold mold powder entrainment should be determined. As such, the inventors conducted an investigation of the molten steel flow velocity in the intra-mold molten steel bath surface. The results are shown in FIG. 1. FIG. 1 shows results obtained through numeric fluid simulation of profiles of molten steel flow velocities of intra-mold molten steel bath surfaces along the direction of the mold width at a mold-thickness-wise central portion, that is, a cast product-thickness-wise central portion in the case that slab a cast product of which the cast product thickness is 220 mm and the cast product width is 1000 mm were produced by casting under three casting conditions shown in Table 1. In this case, the magnetic field is not applied in each of cases 1 to 3. Additionally shown in FIG. 1 are the results of actual measurements of molten steel flows of the molten steel bath surfaces at three points in the direction of the mold width under the casting conditions of the cases 2 and 3 in an actual facility. In the figure, symbol "●" represents the case 2, and symbol "○" represents the case 3. The intra-mold molten steel bath surfaces in the facility were each measured in a manner described hereunder. A thin rod of an Mo—$ZrO_2$ cermet was immersed in the intra-mold molten steel bath surface with an upper end of the thin rod as a rotation support point, and the molten steel flow velocity was obtained by force-equilibrium calculation from the angle at which the thin rod is tilted by a drag force received from the molten steel flow (refer to "Iron and Steel," 86 (2000), p. 271). F values described below are together shown in Table. 1.

TABLE 1

| | Casting speed (m/min) | F value | Ar gas injection amount in immersion nozzle | Immersion nozzle shape | Distance from bath surface to discharge-opening upper end |
|---|---|---|---|---|---|
| Case 1 | 2.8 | 5.1 | 10 Nl/min | Discharge opening shape: Downward 25° 88-mm square opening Pool bottom | 260 mm |
| Case 2 | 2.2 | 3.6 | | | |
| Case 3 | 1.7 | 2.4 | | | |

As shown in FIG. 1, the numeric fluid simulation results and the results of the flow-velocity measurement results in the actual facility are in well conformity to one another. From the numeric simulation results, it can be known that the flow velocities of the molten steel bath surfaces are each accelerated highest at a position spaced apart by a distance of about 50 mm to about 100 mm from the mold short side (the position hereafter will be referred to as "mold short-side vicinity"). Additionally, it can be known therefrom that when the casting speed, that is, molten steel casting flow rate per hour, is increased or reduced, the molten steel bath surface flow velocity in the mold short-side vicinity is increased or reduced in proportion thereto, and similarly, the molten steel flow velocities in other positions in the mold-width direction are increased or reduced. Thus, the molten steel flow velocity in the mold short-side vicinity on the intra-mold molten steel bath surface significantly varies according to the casting conditions. As such, it can be known that the molten steel flow velocity can be used as an index to know the intensity of the intra-mold molten steel flow. Consequently, the inventors have acquired knowledge that, in the state where the magnetic field is not applied, necessariness or unnecessariness of the application of the shifting magnetic field can be sufficiently determined by using the intra-mold molten steel bath surface flow velocity in the mold short-side vicinity as the index.

Generally, it is known that, when the magnetic field is applied according to the EMRS mode, the inclusion-adherence prevention effect is higher as the molten steel flow velocity in the solidifying surface is increased. That is, it is generally known that the mass sizes and the number of inclusions to be entrapped in a solidifying shell are reduced as the flow velocity on the solidifying surface is increased by the EMRS. The inventors therefore performed testing by changing the molten steel flow velocity on the intra-mold molten steel bath surface and measured the amount of inclusions entrapped in the solidifying shell. Thereby, the inventors conducted an investigation to determine a critical flow velocity that does not permit inclusion adherence (hereafter, the flow velocity will be referred to as an "inclusion-adherence critical flow velocity"). Consequently, the inventors verified that when the molten steel flow velocity in the mold short-side vicinity on the intra-mold molten steel bath surface is maintained at 0.20 m/sec or higher, there are not entrapped in the solidifying shell an inclusion having a diameter of 100 μm or larger that can cause a surface defect of a general steel product. That is, the inclusion-adherence critical flow velocity was verified as being 0.20 m/sec.

Inherently, however, when the casting speed is low and the amount of molten steel discharge from the immersion nozzle is small, there is supplied a small amount of new molten steel (high-temperature molten steel immediately after supply from a tundish) to the intra-mold molten steel bath surface. In the EMRS mode, the molten steel is horizontally vortexed. Thereby, reduction occurs in the effect of promoting renewal of molten steel in the intra-mold molten steel bath surface, and adversely, promotion occurs in uniform temperature reduction of the molten steel in the intra-mold molten steel bath surface. As such, when the casting speed is lower than or equal to a certain limit, there can occur skinning and powder absorption associated therewith on the intra-mold molten steel bath surface.

In view of the above, the inventors performed testing by varying the molten steel flow velocity on the intra-mold molten steel bath surface, and thereby conducted an investigation to determine a critical flow velocity for skinning (which hereafter will be referred to as a "bath-surface skinning critical flow velocity"). As a consequence, the inventors discovered that in the event that the molten steel flow velocity in the mold short-side vicinity on the intra-mold molten steel bath surface is lower than 0.10 m/sec, even when the magnetic field is applied according to the EMRS mode, the tendency of inducing skinning on the intra-mold molten steel bath surface is high. In particular, the results verified that the bath-surface skinning critical flow velocity is 10 m/sec.

In this case, preferably, the shifting magnetic field is applied to impart an accelerating force to the discharge flow from the immersion nozzle. With the accelerating force being thus imparted to the discharge flow to accelerate the discharge flow velocity, there is increased the amount of molten steel rising to the intra-mold molten steel bath surface after the discharge flow has impinged on the mold short side. Concurrently, also the molten steel flow velocity of the intra-mold molten steel bath surface is accelerated, so that skinning prevention and inclusion-adherence prevention can be compromised with each other.

A practical process of imparting the accelerating force to the discharge flow from the immersion nozzle is carried out in such a manner that the magnetic field moving horizontally along the directions to the short sides from the side of the immersion nozzle, that is, in the same direction as the discharge direction of the immersion nozzle to induce a molten steel flow that behaves such as imparting an accelerating force to the molten steel discharge flow. In this document, the application process is referred to as "EMLA," "EMLA mode," or "EMLA-mode magnetic field application" (EMLA: electromagnetic level accelerating).

Upon the EMLA-mode magnetic field application, since the discharge flow is accelerated, the discharge flow is brought into impingement on cast product short side surfaces and branched thereby to upper and lower sides along the short-side surfaces. The discharge flow branched to the upper side becomes a molten steel surface flow. This flow consequently forms a circulation flow, which behaves as "discharge flow→short-side upflow stream→molten steel surface flow→merging into discharge flow." The inventors verified that the circulation flow is sufficient to have a flow velocity sufficient to prevent inclusion adherence to the solidifying surface of the long-side surface. As such, by way of a substitute of the EMRS, the EMLA is usable for the means of preventing inclusion adherence to the solidifying shell.

In addition, it is known that the mold-powder entrainment increases as the molten steel flow velocity on the intra-mold molten steel bath surface increases. As such, the inventors performed testing by changing the molten steel flow velocity on the intra-mold molten steel bath surface. Thereby, the inventors conducted an investigation to determine a critical flow velocity of mold-powder entrainment (which hereafter will be referred to as a "mold-powder entrainment critical flow velocity"). As a consequence, the inventors verified that when the molten steel flow velocity in the mold short-side vicinity on the intra-mold molten steel bath surface exceeds 0.32 m/sec, mold-powder entrainment occurs. That is, the mold-powder entrainment critical flow velocity was verified as being 0.32 m/sec.

Additionally verified is that the cast product quality is stabilized when the molten steel flow velocity on the intra-mold molten steel bath surface lies between the mold-powder entrainment critical flow velocity and the inclusion-adherence critical flow velocity. However, the inventors further verified that, in particular, when the molten steel flow velocity in the mold short-side vicinity is 0.25 m/sec, the mold-powder entrainment is minimized and also the inclusion adherence to the solidifying shell is minimized. In other words; it was verified that the molten steel flow velocity in the mold short-side vicinity on the intra-mold molten steel bath surface is preferably maintained at 0.25 m/sec. In describing the present invention hereinafter, the most preferable value of the flow velocity will be referred to as "optimal flow velocity value."

From the results described above, the inventors acquired knowledge that a cast product having high surface quality can be produced by performing casting over a wide rage of casting speeds in the following manner. The boundary values of molten steel flow velocities are provided, and when the molten steel flow velocity on the intra-mold molten steel bath surface is higher than the mold-powder entrainment critical flow velocity, the magnetic field is applied according to the EMLS mode to prevent the mold-powder entrainment. On the other hand, when the molten steel flow velocity on the intra-mold molten steel bath surface is lower than the inclusion-adherence critical flow velocity, the magnetic field is applied according to the EMRS or EMLA mode. Thereby, the molten steel flow velocity on the solidifying surface is maintained to prevent the inclusion adherence. Further, the inventors acquired knowledge that a cast product having even higher surface quality can be produced by casting over a wide rage of casting speeds in the following manner. When the molten steel flow velocity on the intra-mold molten steel bath surface is lower than the bath-surface skinning critical flow velocity, the magnetic field is applied according to the EMLA mode. Thereby, molten steel on the intra-mold molten steel bath surface is renewed, and concurrently, the molten steel flow velocity on the intra-mold molten steel bath surface is maintained.

[1] In addition, the inventors acquired knowledge described hereunder. Suppose that the molten steel flow velocity on the intra-mold molten steel bath surface lies between the optimal flow velocity value and the mold-powder entrainment critical flow velocity. Even in this case, a cast product of even higher surface quality can be produced by casting by applying the magnetic field according to the EMLA mode to control the molten steel surface flow velocity close to the optimal flow velocity value. On the other hand, suppose the molten steel flow velocity on the intra-mold molten steel bath surface lies between the optimal flow velocity value and the inclusion-adherence critical flow velocity. Even in this case, a cast product of even higher surface quality can be produced by applying the magnetic field according to the EMRS or EMLA mode to control the molten steel surface flow velocity close to the optimal flow velocity value.

By way of means for obtaining the molten steel flow velocity on the intra-mold molten steel bath surface in a state where the magnetic field is not applied, a number of processes are known. In the present invention case, it is preferable to use a bath-surface fluctuation index (hereafter referred to as an "F value"), which is an empirical equation that expresses an intra-mold bath-surface fluctuation proposed by Tejima et al. ("Iron and Steel," 79 (1993), p. 576). The F value is expressed by Equation (5) shown below, and the magnitude of the bath-surface fluctuation is known as having a proportional relationship between the intra-mold molten steel bath surface and the molten steel flow velocity. As such, the molten steel flow velocity value can be theoretically predicted.

$$F\ \text{value}=\rho\cdot Q_L\cdot Ve\cdot((1-\sin\theta)/4)\cdot(1/D) \tag{5}$$

Then, by way of an equation expressing the molten steel flow velocity on the intra-mold molten steel bath surface in the present case, we used Equation (4) modified for the F value, as shown below. The molten steel flow velocity value on the intra-mold molten steel bath surface can be predicted by calculation with Equation (4) shown below in accordance with casting conditions. Equation (4) is proposed as an equation of expressing the molten steel flow velocity in the mold short-side vicinity.

$$u=k\cdot\rho\cdot Q_L\cdot Ve\cdot((1-\sin\theta)/2)\cdot(1/D) \tag{4}$$

In Equations (4) and (5), u is the molten steel flow velocity on the intra-mold molten steel bath surface, that is, the molten steel surface flow velocity (m/sec); k is a coefficient; ρ is the density of the molten steel (kg/m$^3$); $Q_L$ is a molten steel pouring volume per unit time (m$^3$/sec); Ve is a velocity of the molten steel discharge flow when impinging on the mold-short-side surface side (m/sec) θ is an angle (deg) of the molten steel discharge flow with respect to horizontality in a position where the molten steel discharge flow impinges on the mold-short-side surface side; and D is a distance (m) to the intra-mold molten steel bath surface from the position at which the molten steel discharge flow impinges on the mold-short-side surface side. Equation (5) is an empirical equation derived from experiment results "the momentum of an upflow stream formed in the manner that the molten steel discharge flow impinged on the mold-short-side surface side is branched into upper and lower bidirectional sides causes, for example, swelling and fluctuation of the intra-mold molten steel bath surface."

More specifically, the molten steel pouring volume discharged to the one mold short side from the immersion nozzle having two discharge openings in a lower portion is $Q_L/2$. In addition, when the velocity of impingement to the mold-short-side surface side is Ve, the momentum that the molten steel discharge flow has at the event of the impingement is $\rho Q_L$ Ve/2. The molten steel flow after the impingement is separated at a ratio of (1−sin θ/2) to the upper side and (1+sin θ/2) to the lower side. Accordingly, the momentum of the molten steel flow to the upper side after the impingement is expressed by ($\rho Q_L$ Ve/2)×(1−sin θ/2). The momentum retained in the molten steel amount at the event of the impingement attenuates until the molten steel flow rises and reaches the molten steel bath surface. As such, the momentum retained in the molten steel flow when the molten steel flow has reached the molten steel bath surface is contemplated to become $1/D_n$ (ordinarily, n=about 1) of the momentum retained at the event of the impingement. Accordingly, the upflow stream has the momentum shown in Equation (5) in the intra-mold molten steel bath surface position. The velocity (Ve), angle (θ), and distance (D) can be separately obtained from regression equations.

The molten steel flow velocity in the mold short-side vicinity on the intra-mold molten steel bath surface in the actual facility was measured to verify validation of Equation (4). The results are shown in FIG. 2. FIG. 2 is a view showing the relationship between the molten steel flow velocity in the mold short-side vicinity on the intra-mold molten steel bath surface, which was measured in the actual facility, and the F value calculated in accordance with the casting conditions at the corresponding event. The measurement results were obtained such that cast products having a thickness of 220 mm and a width of 1550 mm to 1600 mm were produced by casting at a casting speed of 1.4 m/min to 2.1 m/min by using a pool-bottom attached immersion nozzle having a downward discharge opening angle of 45° and a 88-mm square discharge opening shape. Clearly from FIG. 2, it can be known that even in the actual measurement results in the actual facility, a good proportional relationship is established between the F value and the molten steel flow velocity in the mold short-side vicinity on the intra-mold molten steel bath surface. That is, it can be known that the intra-mold molten steel surface flow velocity can be predicted in accordance with Equation (4). In this connection, the inventors verified that there is the relationship "molten steel surface flow velocity u (m/sec)= 0.074×F value" between the F value and the molten steel surface flow velocity (u), and the relationship is applicable to all the casting conditions.

From this relationship, the above-described mold-powder entrainment critical flow velocity (=0.32 m/sec), the optimal flow velocity value (=0.25 m/sec), the inclusion-adherence critical flow velocity (=0.20 m/sec), and the bath-surface skinning critical flow velocity (=0.10 m/sec) can all be expressed by F values. Specifically, the F value corresponding to the mold-powder entrainment critical flow velocity (hereafter referred to as a "mold-powder entrainment critical F value") is 4.3, the F value corresponding to the optimal flow velocity value (hereafter referred to as an "optimal F value") is 3.4, the F value corresponding to the inclusion-adherence critical flow velocity (hereafter referred to as an "inclusion-adherence critical F value") is 2.7, and the F value corresponding to the bath-surface skinning critical flow velocity (hereafter referred to as a "bath-surface skinning critical F value") is 1.4. Accordingly, the intra-mold molten steel flows can be controlled by directly using the F values without converting the F values into the molten steel flow velocities by using the Equation (4).

The intensity of the magnetic field should be set a predetermined intensity to control the intra-mold molten steel flow by applying the shifting magnetic field. In the present invention, the intensity of the magnetic field is set as described below.

The shifting magnetic field acting as rotating the intra-mold molten steel in the horizontal direction, that is, the intensity of the EMRS, can be obtained according to the manner described hereunder.

A Lorentz force F on a unit volume of the molten steel is expressed by Equation (6) given below. In Equation (6), σ is an electrical conductivity, R is a relative velocity between the molten steel and the magnetic field, B is a magnetic flux density.

$$F \propto \sigma \cdot R \cdot B^2 \tag{6}$$

[1] A task Q to be performed while the Lorentz force F is acting on the molten steel having a volume Z is expressed by Equation (7) given below. In Equation (7), τ is a pole pitch of a shifting magnetic field generating apparatus, f is an input current frequency to be input to the shifting magnetic field generating apparatus, and ρ is a molten steel density.

$$Q = F \cdot \rho \cdot Z = \sigma \cdot 2\tau \cdot f \cdot B^2 \cdot \rho \cdot Z \tag{7}$$

[2] When the task Q is converted into kinetic energy of the entire molten steel by disregarding losses, equation (8) shown below can be obtained. From a solution of the equation (8) for a relative velocity R, equation (9) shown below can be obtained.

$$\tfrac{1}{2} \cdot \rho \cdot Z \cdot R2 = \sigma \cdot 2\tau \cdot f \cdot B^2 \cdot \rho \cdot Z \tag{8}$$

$$R = \sqrt{4 \cdot \tau \cdot \sigma \cdot f} \cdot B \tag{9}$$

In a practical operation, slippage additionally occurs between the moving velocity of the shifting magnetic field and the moving velocity of the driven molten steel. As such, when a coefficient γ is provide in consideration of the above and to be determined in units of the apparatus is provided, Equation (9) is expressed by Equation (1) given below. That is, when applying the shifting magnetic field according to the EMRS mode, the shifting magnetic field is preferably applied at the magnetic flux density B determined in Equation (1).

$$R = \gamma \cdot B \cdot \sqrt{f} \tag{1}$$

The shifting magnetic field to be applied to impart the accelerating force to the discharge flow from the immersion nozzle, that is the intensity of the EMLA can be obtained in a manner described hereunder.

As described above, Equation (6) represents the Lorentz force F per unit volume of the molten steel that acts when the magnetic field of the magnetic flux density B is applied to the molten steel having the density ρ and electrical conductivity σ under the condition of the relative velocity R. An absolute value Au of a velocity variation amount of the molten steel when the Lorentz force F is applied only for a duration of a time Δt is expressed by Equation (10) given below.

$$\Delta u = (\sigma \cdot R \cdot B^2 / \rho) \cdot \Delta t \tag{10}$$

Now, the molten steel bath surface flow velocity in the state without the EMLA application is represented by $u_0$, and an average value of linear velocities of molten steel discharge flows along the mold-width direction from the immersion-nozzle discharge opening is represented by $U_0$. Concurrently, the molten steel bath surface flow velocity after the EMLA application is represented by $u_1$, and an average value of a linear velocity of a molten steel discharge flow along the mold-width direction from the immersion-nozzle discharge opening after the EMLA application is represented by $U_1$, and further, the moving velocity of the EMLA magnetic field is represented by L. In this case, the relative velocity of the magnetic field as seen from the discharge flow is expressed as $(L-U_0)$. In addition, a velocity variation rate Av of the molten steel bath surface flow velocity in the EMLA is represented by Equation (11) shown below.

$$Av = u_1/u_0 \propto (U_0 + \Delta U)/U_0 = 1 + (\sigma/\rho)\cdot(L-U_0)/U_0\cdot B^2\cdot\Delta t \quad (11)$$

In this case, when the time Δt is represented by a ratio between the flow velocity $U_0$ of the discharge flow and a mold width W, the velocity variation rate Av is expressed as Equation (12) as follows.

$$Av=1+(\sigma/\rho)\cdot L-U_0)/U_0\cdot B^2\cdot(W/U_0) \quad (12)$$

Further, when $\epsilon=(\sigma/\rho)\cdot W$, the velocity variation rate Av is expressed as $(L-U_0)/U_0\cdot B^2\cdot(W/U_0)$. Specifically, when applying the shifting magnetic field according to the EMLA mode, the shifting magnetic field is preferably applied at the magnetic flux density B determined by Equation (2) given below.

$$Av=1+\epsilon\cdot(L-U_0)/U_0^2\cdot B^2 \quad (2)$$

The inventors conducted an investigation to very whether Equation (2) actually holds true in the actual facility. The investigation was conducted by using the above-described measuring process for the method molten steel flow velocity while an EMLA input current was being changed stepwise. That is, the Mo—$ZrO_2$ cermet thin rod was immersed in the molten steel bath, and the molten steel flow velocity was obtained from the angle at which the thin rod is tilted by a drag force received from the molten steel. Casting conditions in this case were set as—cast product thickness: 250 mm; cast product width: 1186 mm; casting speed: 1.0 m/min; injection amount of the Ar gas to the immersion nozzle: 12 Nl/min; and immersion nozzle used: with a downward discharge opening angle of 25° and an 85-mm square opening.

FIG. 3 shows the relationship between the EMLA input current and the molten steel surface flow velocity, which was obtained as a result of the investigation. In addition, FIG. 4 shows the result of investigation of the relationship between the velocity variation rate Av of Equation (2) shown on the vertical axis, and $(L-U_0)/U_0^2\cdot B^2$ of Equation (2), shown on the horizontal axis. In this case, $U_0$ can be obtained by averaging discharge flow velocities in the mold-width direction that are obtained by Equation (13) described below and that are used in the stage of calculating molten steel surface flow velocities from F values.

[1] As shown in FIG. 4, the plots in FIG. 4 take place on a straight line, from which it can be known that the relationship of Equation (2) hold true also in the EMLA application in the actual facility. A tilt of the approximation straight line in FIG. 4 corresponds to ϵ of Equation (2). As such, if similar experiments are conducted with a plurality of mold widths to obtain ϵ in the individual mold widths, the magnetic flux density B of the EMLA corresponding to a necessary velocity variation rate Av can be calculated from Equation (2).

[2] To calculate the intensity of the shifting magnetic field, i.e., the EMLS, for imparting the braking force, it is preferable to use Equation (3), shown below, that is disclosed in Japanese Patent No. 3125665 to the inventors of the present application. In Equation (3), Rv represents a ratio in the case where a positive numeric value represents a flow velocity of the molten steel directed to the side of the immersion nozzle from the side of the mold short side, a negative numeric value represents the molten steel flow velocity of the flow in the opposite direction, the denominator represents the intra-mold molten steel surface flow velocity when casting is performed with no shifting magnetic field being applied, and the numerator represents the intra-mold molten steel surface flow velocity in the event that the shifting magnetic field is applied at the magnetic flux density B. In the equation, β is a coefficient, B is the magnetic flux density (Tesla) of the shifting magnetic field, and $V_0$ is linear velocity (m/sec) of the molten steel discharge flow from the immersion-nozzle discharge opening.

$$Rv=1-\beta\cdot B^4/V_0 \quad (3)$$

[3] In this case, flow velocities disclosed in Japanese Patent No. 3125664 to the inventors of the present application is preferably used for post-EMLS-application target flow velocities that are to be assigned to the numerator of Rv of Equation (3). Specifically, the molten steel flow velocity of the flow proceeding to the side of the immersion nozzle from the side of the mold short side is represented by a positive numeric value, and the molten steel flow velocity of the flow in an opposite direction thereof is represented by a negative numeric value. In this case, the molten steel flow velocity on the molten steel bath surface in a cast product thickness-wise central position spaced apart by a distance of ¼ of the mold width from the immersion nozzle toward the side of the mold short side is controlled to fall within a range of from −0.07 m/sec to 0.05 m/sec.

In this case, it should be noted that the post-EMLS-application molten steel flow velocity in the above-described position is in the range of −0.07 m/sec to 0.05 m/sec. As a simple flow velocity value, not only the values are lower than the mold-powder entrainment critical flow velocity, but also the value is lower than the value, such as the inclusion-adherence critical flow velocity or the skinning critical flow velocity, when the magnetic field is not applied. However, the inventors verified that the flow velocity on the solidifying surface, which is developed to an inclusion adhesion site, is maintained as necessary for inclusion adhesion prevention, and further, heat supply to the intra-mold molten steel bath surface is maintained as necessary, whereby even skinning on the molten steel bath surface is not caused.

A reason for the above is that in the EMLS application, the intra-mold molten steel flow pattern is significantly different in comparison with that in the case where the magnetic field is not applied. More specifically, as shown in FIG. 5, when the magnetic field is not applied, there are formed an immediately-below-bath-surface molten steel flow 21 formed by a molten steel discharge flow 4 and an interface molten steel flow 22 formed with that flow along the solidifying surface. In the EMLS application, however, the inherent immediately-below-bath-surface molten steel flow 21 formed by the pre-EMLS-application molten steel discharge flow 4 is directed opposite an immediately-below-bath-surface molten steel flow 23 formed by a molten steel flow driven by the EMLS application. When these molten steel flows are balanced, flow velocities of these flows are reduced, an immediately-below-bath-surface molten steel flow velocity in a cast product-thickness-wise central portion position 25 spaced apart by a distance of ¼ of the mold width to the mold short side is reduced to the vicinity of 0 m/sec.

In this case, the molten steel discharge flow 4 reduced by the EMLS application diverges along the mold-long-side surface. Thereby, the molten steel flow velocity on the solidifying surface is maintained with an interface molten steel flow 24 generated by the divergence and is then directed along the solidifying surface. Concurrently, the heat supply to the molten steel bath surface is maintained. FIG. 5 has views schematically showing the intra-mold molten steel flow, in which (A) is a view showing a state without the magnetic field being applied, and (B) is a view showing a state with the EMLS application. In the views, numeral 11 denotes the immersion nozzle.

The present invention is made in accordance with the above studies and researches. An intra-mold molten steel flow control method according to a first invention is a method for controlling flow of intra-mold molten steel by applying a shifting magnetic field to the intra-mold molten steel in a slab continuous casting machine, the method being characterized by comprising controlling a molten steel flow velocity on an intra-mold molten steel bath surface to a predetermined molten steel flow velocity by applying a shifting magnetic field to impart a braking force to a discharge flow from an immersion nozzle when the molten-steel flow velocity on the molten steel bath surface is higher than a mold-powder entrainment critical flow velocity; and controlling the molten steel flow velocity on the intra-mold molten steel bath surface to a range of from a level higher than or equal to an inclusion-adherence critical flow velocity to a level lower than or equal to a mold-powder entrainment critical flow velocity by applying the shifting magnetic field to increase the intra-mold molten steel flow when the molten-steel flow velocity on the molten steel bath surface is lower than the inclusion-adherence critical flow velocity.

An intra-mold molten steel flow control method according to a second invention is a method for controlling flow of intra-mold molten steel by applying a shifting magnetic field to the intra-mold molten steel in a slab continuous casting machine, the method being characterized by comprising controlling a molten steel flow velocity on an intra-mold molten steel bath surface to a predetermined molten steel flow velocity by applying a shifting magnetic field to impart a braking force to a discharge flow from an immersion nozzle when the molten-steel flow velocity on the molten steel bath surface is higher than a mold-powder entrainment critical flow velocity; and controlling the molten steel flow velocity on the intra-mold molten steel bath surface to a range of from a level higher than or equal to an inclusion-adherence critical flow velocity to a level lower than or equal to a mold-powder entrainment critical flow velocity by applying a shifting magnetic field to rotate the intra-mold molten steel in a horizontal direction when the molten-steel flow velocity on the molten steel bath surface is lower than the inclusion-adherence critical flow velocity.

An intra-mold molten steel flow control method according to a third invention is characterized in that in the second invention, in the event of applying the shifting magnetic field to rotate the intra-mold molten steel in the horizontal direction, a magnetic flux density of the shifting magnetic field is determined according to Equation (1) given above.

An intra-mold molten steel flow control method according to a fourth invention is a method for controlling flow of intra-mold molten steel by applying a shifting magnetic field to the intra-mold molten steel in a slab continuous casting machine, the method being characterized by comprising controlling a molten steel flow velocity on an intra-mold molten steel bath surface to a predetermined molten steel flow velocity by applying a shifting magnetic field to impart a braking force to a discharge flow from an immersion nozzle when the molten-steel flow velocity on the molten steel bath surface is higher than a mold-powder entrainment critical flow velocity; and controlling the molten steel flow velocity on the intra-mold molten steel bath surface to a range of from a level higher than or equal to an inclusion-adherence critical flow velocity to a level lower than or equal to a mold-powder entrainment critical flow velocity by applying a shifting magnetic field to impart an accelerating force to the discharge flow from the immersion nozzle when the molten-steel flow velocity on the molten steel bath surface is lower than the inclusion-adherence critical flow velocity.

[1] An intra-mold molten steel flow control method according to a fifth invention is characterized in that in the fourth invention, in the event of applying the shifting magnetic field to impart the accelerating force to the discharge flow from the immersion nozzle, a magnetic flux density of the shifting magnetic field is determined according to Equation (2) given above.

[2] An intra-mold molten steel flow control method according to a sixth invention is characterized in that in the first to fifth inventions, in the event of applying the shifting magnetic field to impart the braking force to the discharge flow from the immersion nozzle, the magnetic flux density of the shifting magnetic field is determined according to Equation (3) given above.

[3] An intra-mold molten steel flow control method according to a seventh invention is characterized in that in the sixth invention, the mold-powder entrainment critical flow velocity is 0.32 m/sec, and the inclusion-adherence critical flow velocity is 0.20 m/sec.

[4] An intra-mold molten steel flow control method according to an eighth invention is a method for controlling flow of intra-mold molten steel by applying a shifting magnetic field to the intra-mold molten steel in a slab continuous casting machine, the method being characterized by comprising controlling a molten steel flow velocity on an intra-mold molten steel bath surface to a predetermined molten steel flow velocity by applying a shifting magnetic field to impart a braking force to a discharge flow from an immersion nozzle when the molten-steel flow velocity on the molten steel bath surface is higher than a mold-powder entrainment critical flow velocity; controlling the molten steel flow velocity on the intra-mold molten steel bath surface to a range of from a level higher than or equal to an inclusion-adherence critical flow velocity to a level lower than or equal to a mold-powder entrainment critical flow velocity by applying a shifting magnetic field to rotate the intra-mold molten steel in a horizontal direction when the molten-steel flow velocity on the molten steel bath surface is lower than the inclusion-adherence critical flow velocity and is higher than or equal to a bath-surface skinning critical flow velocity; and controlling the molten steel flow velocity on the intra-mold molten steel bath surface to the range of from the level higher than or equal to the inclusion-adherence critical flow velocity to the level lower than or equal to the mold-powder entrainment critical flow velocity by applying a shifting magnetic field to impart an accelerating force to the discharge flow from the immersion nozzle when the molten-steel flow velocity on the molten steel bath surface is lower than the bath-surface skinning critical flow velocity.

An intra-mold molten steel flow control method according to a ninth invention is characterized in that in the eighth invention, in the event of applying the shifting magnetic field to rotate the intra-mold molten steel in the horizontal direction, a magnetic flux density of the shifting magnetic field is determined according to Equation (1) given above.

An intra-mold molten steel flow control method according to a tenth invention is characterized in that in the eighth or ninth invention, in the event of applying the shifting magnetic field to impart the accelerating force to the discharge flow from the immersion nozzle, a magnetic flux density of the shifting magnetic field is determined according to Equation (2) given above.

An intra-mold molten steel flow control method according to an 11th invention is characterized in that in any one of the eighth to tenth inventions, in the event of applying the shifting magnetic field to impart the braking force to the discharge flow from the immersion nozzle, the magnetic flux density of the shifting magnetic field is determined according to Equation (3) given above.

An intra-mold molten steel flow control method according to a 12th invention is characterized in that in the eighth to 11th inventions, the mold-powder entrainment critical flow velocity is 0.32 m/sec, the inclusion-adherence critical flow velocity is 0.20 m/sec, and the bath-surface skinning critical flow velocity is 0.10 m/sec.

An intra-mold molten steel flow control method according to a 13th invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when a molten-steel flow velocity on a molten steel bath surface is higher than an optimal flow velocity value at which mold-powder entrainment is minimized and inclusion adherence to a solidifying shell is minimized; and applying a shifting magnetic field to rotate the intra-mold molten steel in a horizontal direction when the molten-steel flow velocity on the molten steel bath surface is lower than the optimal flow velocity value.

An intra-mold molten steel flow control method according to a 14th invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when a molten-steel flow velocity on a molten steel bath surface is higher than an optimal flow velocity value at which mold-powder entrainment is minimized and inclusion adherence to a solidifying shell is minimized; and applying a shifting magnetic field to impart an accelerating force to the discharge flow from the immersion nozzle when the molten-steel flow velocity on the molten steel bath surface is lower than the optimal flow velocity value.

[1] An intra-mold molten steel flow control method according to a 15th invention is characterized in that in the 13th or 14th invention, the optimal flow velocity value is 0.25 m/sec.

[2] An intra-mold molten steel flow control method according to a 16th invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when a molten-steel flow velocity on a molten steel bath surface is higher than an optimal flow velocity value at which mold-powder entrainment is minimized and inclusion adherence to a solidifying shell is minimized; applying a shifting magnetic field to rotate the intra-mold molten steel in a horizontal direction when the molten-steel flow velocity on the molten steel bath surface is lower than the optimal flow velocity value and is higher than or equal to a bath-surface skinning critical flow velocity; and applying the molten steel flow velocity on the intra-mold molten steel bath surface to impart an accelerating force to the discharge flow from the immersion nozzle when the molten-steel flow velocity on the molten steel bath surface is lower than the bath-surface skinning critical flow velocity.

[3] An intra-mold molten steel flow control method according to a 17th invention is characterized in that in the 16th invention, the optimal flow velocity value is 0.25 m/sec, and the bath-surface skinning critical flow velocity is 0.10 m/sec.

[4] An intra-mold molten steel flow control method according to an 18th invention is characterized in that in the first to 17th invention, in the event of applying the shifting magnetic field to control the molten steel flow velocity on the intra-mold molten steel bath surface to impart the braking force to the discharge flow from the immersion nozzle, when a positive numeric value represents a flow velocity of the molten steel directed to the side of the immersion nozzle from the side of the mold short side and a negative numeric value represents the molten steel flow velocity of the flow in the direction opposite thereto, the molten steel flow velocity on the molten steel bath surface in a cast product thickness-wise central position spaced apart by a distance of ¼ of the mold width from the immersion nozzle toward the side of the mold short is controlled to fall within a range of from −0.07 m/sec to 0.05 m/sec.

[5] An intra-mold molten steel flow control method according to a 19th invention is characterized in that in any one of the first to 19th invention, when applying the shifting magnetic field, the method predicts the molten steel flow velocity on the intra-mold molten steel bath surface in a state where no magnetic field is applied according to Equation (4) given above, and applies a predetermined shifting magnetic field in accordance with a predicted molten steel flow velocity.

An intra-mold molten steel flow control method according to a 20th invention is characterized in that in the 19th invention, molten steel flow velocities on the intra-mold molten steel bath surface are repeatedly predicted by using Equation (4) during casting, and predetermined shifting magnetic fields are serially applied in accordance with the predicted molten steel flow velocities.

An intra-mold molten steel flow control method according to a 21st invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when an F value shown in Equation (5) that is obtainable from casting conditions is higher than a mold-powder entrainment critical F value; and applying a shifting magnetic field to rotate the intra-mold molten steel in a horizontal direction when the F value is lower than the mold-powder entrainment critical F value.

An intra-mold molten steel flow control method according to a 22nd invention is characterized in that in the 21st invention, in the event of applying the shifting magnetic field to rotate the intra-mold molten steel in the horizontal direction, a magnetic flux density of the shifting magnetic field is determined according to Equation (1) given above.

An intra-mold molten steel flow control method according to a 23rd invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when an F value shown in Equation (5) that is obtainable from casting conditions is higher than a mold-powder entrainment critical F value; and applying a shifting magnetic field to impart an accelerating force to a discharge flow from an immersion nozzle when the F value is lower than the mold-powder entrainment critical F value.

An intra-mold molten steel flow control method according to a 24th invention is characterized in that in the 23rd invention, in the event of applying a shifting magnetic field to impart the accelerating force to the discharge flow from the immersion nozzle, a magnetic flux density of the shifting magnetic field is determined according to Equation (2) given above.

[1] An intra-mold molten steel flow control method according to a 25th invention is characterized in that in any one of the 21st to 24th inventions, in the event of applying the shifting magnetic field to impart the braking force to the discharge flow from the immersion nozzle, the magnetic flux density of the shifting magnetic field is determined according to Equation (3) given above.

[2] An intra-mold molten steel flow control method according to a 26th invention is characterized in that in the any one of 21st to 25th inventions, the mold-powder entrainment critical F value is 4.3, and the inclusion-adherence critical F value is 2.7.

[3] An intra-mold molten steel flow control method according to a 27th invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when an F value shown in Equation (5) that is obtainable from casting conditions is higher than a mold-powder entrainment critical F value; applying a shifting magnetic field to rotate the intra-mold molten steel in a horizontal direction when the F value is lower than an inclusion-adherence critical F value and is higher than or equal to a bath-surface skinning critical F value; and applying a shifting magnetic field to impart an accelerating force to a discharge flow from an immersion nozzle when the F value is lower than bath-surface skinning critical F value.

[4] An intra-mold molten steel flow control method according to a 28th invention is characterized in that in the 27th invention, in the event of applying the shifting magnetic field to rotate the intra-mold molten steel in the horizontal direction, a magnetic flux density of the shifting magnetic field is determined according to Equation (1) given above.

[5] An intra-mold molten steel flow control method according to a 29th invention is characterized in that in the 27th or 28th invention, in the event of applying the shifting magnetic field to impart the accelerating force to the discharge flow from the immersion nozzle, a magnetic flux density of the shifting magnetic field is determined according to Equation (2) given above.

[6] An intra-mold molten steel-flow control method according to a 30th invention is characterized in that in any one of the 27th to 29th inventions, in the event of applying the shifting magnetic field to impart the braking force to the discharge flow from the immersion nozzle, the magnetic flux density of the shifting magnetic field is determined according to Equation (3) given above.

An intra-mold molten steel flow control method according to a 31st invention is characterized in that in any one of the 27th to 30th inventions, the mold-powder entrainment critical F value is 4.3, the inclusion-adherence critical F value is 2.7, and the bath-surface skinning critical F value is 1.4.

An intra-mold molten steel flow control method according to a 32nd invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when an F value shown in Equation (5) that is obtainable from casting conditions is higher than an optimal F value at which mold-powder entrainment is minimized and inclusion adherence to a solidifying shell is minimized; and applying a shifting magnetic field to rotate the intra-mold molten steel in a horizontal direction when the F value is lower than the optimal F value.

An intra-mold molten steel flow control method according to a 33rd invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when an F value shown in Equation (5) that is obtainable from casting conditions is higher than an optimal F value at which mold-powder entrainment is minimized and inclusion adherence to a solidifying shell is minimized; and applying a shifting magnetic field to impart an accelerating force to the discharge flow from the immersion nozzle when the F value is lower than the optimal F value.

An intra-mold molten steel flow control method according to a 34th invention is characterized in that in the 32nd or 33rd invention, the optimal F value is 3.4.

[1] An intra-mold molten steel flow control method according to a 35th invention is a method for controlling flow of intra-mold molten steel by applying a shifting magnetic field to the intra-mold molten steel in a slab continuous casting machine, the method being characterized by comprising applying a shifting magnetic field to impart a braking force to a discharge flow from an immersion nozzle when an F value shown in Equation (5) that is obtainable from casting conditions is higher than an optimal F value at which mold-powder entrainment is minimized and inclusion adherence to a solidifying shell is minimized; applying a shifting magnetic field to rotate the intra-mold molten steel in a horizontal direction when the F value is lower than the optimal F value and is higher than or equal to a bath-surface skinning critical F value; and applying a shifting magnetic field to impart an accelerating force to the discharge flow from the immersion nozzle when the F value is lower than the bath-surface skinning critical F value.

[2] An intra-mold molten steel flow control method according to a 36th invention is characterized in that in the 35th invention, the optimal F value is 3.4, and the bath-surface skinning critical F value is 1.4.

[3] An intra-mold molten steel flow control method according to a 37th invention is characterized in that in any one of the 21st to 36th inventions, in the event of applying the shifting magnetic field to control the molten steel flow velocity on the intra-mold molten steel bath surface to impart the braking force to the discharge flow from the immersion nozzle, when a positive numeric value represents a flow velocity of the molten steel directed to the side of the immersion nozzle from the side of the mold short side and a negative numeric value represents the molten steel flow velocity of the flow in the direction opposite thereto, the molten steel flow velocity on the molten steel bath surface in a cast product thickness-wise central position spaced apart by a distance of ¼ of the mold width from the immersion nozzle toward the side of the mold short is controlled to fall within a range of from −0.07 m/sec to 0.05 m/sec.

[4] An intra-mold molten steel flow control method according to a 38th invention is characterized in that in any one of the 21st to 37th inventions, F values are repeatedly calculated by using Equation (5) during casting, and predetermined shifting magnetic fields are serially applied in accordance with the calculated F values.

[5] An intra-mold molten steel flow control method according to a 39th invention is a method characterized by comprising a first step of acquiring at least five conditions as casting conditions on a cast product thickness, a cast product width, a casting speed, an amount of inert gas injection into a molten steel outflow opening nozzle, and an immersion nozzle shape; a second step of calculating a molten steel flow velocity on an intra-mold molten steel bath surface in accordance with the acquired casting conditions; a third step of determining whether the acquired molten steel flow velocity is higher than a mold-powder entrainment critical flow velocity and whether the molten steel flow velocity is lower than an inclusion-adherence critical flow velocity by comparing the acquired molten steel flow velocity with the mold-powder entrainment critical flow velocity and the inclusion-adherence critical flow velocity; and a fourth step of applying a shifting magnetic field to impart a braking force to a discharge flow from an immersion nozzle when the acquired molten steel flow velocity is higher than the mold-powder entrainment critical flow velocity, and applying a shifting magnetic field to rotate the intra-mold molten steel in a horizontal direction when the acquired molten steel flow velocity is lower than the inclusion-adherence critical flow velocity, wherein the flow of intra-mold molten steel is controlled by applying a predetermined shifting magnetic field to the intra-mold molten steel in a slab continuous casting machine.

[6] An intra-mold molten steel flow control method according to a 40th invention is a method characterized by comprising a first step of acquiring at least five conditions as casting conditions on a cast product thickness, a cast product width, a casting speed, an amount of inert gas injection into a molten steel outflow opening nozzle, and an immersion nozzle shape; a second step of calculating a molten steel flow velocity on an intra-mold molten steel bath surface in accordance with the acquired casting conditions; a third step of determining whether the acquired molten steel flow velocity is higher than a mold-powder entrainment critical flow velocity, whether the molten steel flow velocity is lower than an inclusion-adherence critical flow velocity, and whether the molten steel flow velocity is lower than a bath-surface skinning critical flow velocity by comparing the acquired molten steel flow velocity with the mold-powder entrainment critical flow velocity, the inclusion-adherence critical flow velocity, and the bath-surface skinning critical flow velocity; and a fourth step of applying a shifting magnetic field to impart a braking force to a discharge flow from an immersion nozzle when the acquired molten steel flow velocity is higher than the mold-powder entrainment critical flow velocity, applying a shifting magnetic field to rotate the intra-mold molten steel in a horizontal direction when the acquired molten steel flow velocity is lower than the inclusion-adherence critical flow velocity and is higher than or equal to the bath-surface skinning critical flow velocity, and applying a shifting magnetic field to impart an accelerating force to a discharge flow from an immersion nozzle, wherein the flow of intra-mold molten steel is controlled by applying a predetermined shifting magnetic field to the intra-mold molten steel in a slab continuous casting machine.

[7] An intra-mold molten steel flow control method according to a 41st invention is characterized in that in the 39th or 40th invention, the first to fourth steps are repeatedly executed during casting, and an optimal shifting magnetic field is applied in response to casting conditions during the execution.

An intra-mold molten steel flow control apparatus according to a 42nd invention is an apparatus for controlling flow of intra-mold molten steel by applying a shifting magnetic field to the intra-mold molten steel in a slab continuous casting machine, the apparatus being characterized by comprising casting-condition acquiring means for acquiring at least five conditions as casting conditions on a cast product thickness, a cast product width, a casting speed, an amount of inert gas injection into a molten steel outflow opening nozzle, and an immersion nozzle shape; calculating means for calculating a molten steel flow velocity on an intra-mold molten steel bath surface in accordance with the acquired casting conditions; determining means for determining whether the acquired molten steel flow velocity is higher than a mold-powder entrainment critical flow velocity and whether the molten steel flow velocity is lower than an inclusion-adherence critical flow velocity by comparing the acquired molten steel flow velocity with the mold-powder entrainment critical flow velocity and the inclusion-adherence critical flow velocity, control means for applying a shifting magnetic field to impart a braking force to a discharge flow from an immersion nozzle when the acquired molten steel flow velocity is higher than the mold-powder entrainment critical flow velocity, and applying a shifting magnetic field to rotate the intra-mold molten steel in a horizontal direction when the acquired molten steel flow velocity is lower than the inclusion-adherence critical flow velocity; and a shifting magnetic field generating apparatus for generating a predetermined shifting magnetic field in accordance with an output from the control means.

An intra-mold molten steel flow control apparatus according to a 43rd invention is an apparatus for controlling flow of intra-mold molten steel by applying a shifting magnetic field to the intra-mold molten steel in a slab continuous casting machine, the apparatus being characterized by comprising casting-condition acquiring means for acquiring at least five conditions as casting conditions on a cast product thickness, a cast product width, a casting speed, an amount of inert gas injection into a molten steel outflow opening nozzle, and an immersion nozzle shape; calculating means for calculating a molten steel flow velocity on an intra-mold molten steel bath surface in accordance with the acquired casting conditions; determining means for determining whether the acquired molten steel flow velocity is higher than a mold-powder entrainment critical flow velocity, whether the molten steel flow velocity is lower than an inclusion-adherence critical flow velocity, and whether the molten steel flow velocity is lower than a bath-surface skinning critical flow velocity by comparing the acquired molten steel flow velocity with the mold-powder entrainment critical flow velocity, the inclusion-adherence critical flow velocity, and the bath-surface skinning critical flow velocity; control means for applying a shifting magnetic field to impart a braking force to a discharge flow from an immersion nozzle when the acquired molten steel flow velocity is higher than the mold-powder entrainment critical flow velocity, applying a shifting magnetic field to rotate the intra-mold molten steel in a horizontal direction when the acquired molten steel flow velocity is lower than the inclusion-adherence critical flow velocity and is higher than or equal to the bath-surface skinning critical flow velocity, and applying a shifting magnetic field to impart an accelerating force to the discharge flow from the immersion nozzle when the acquired molten steel flow velocity is lower than the bath-surface skinning critical flow velocity; and a shifting magnetic field generating apparatus for generating a predetermined shifting magnetic field in accordance with an output from the control means.

A continuous-casting cast product manufacturing method according to a 44th invention is characterized in that while intra-mold molten steel flow control is being executed in accordance with the flow control method as defined in any one of claims 1 to 41, molten steel in a tundish is poured into a mold, and a slab cast product is manufactured by withdrawing a solidifying shell created in the mold.

EMBODIMENTS OF THE INVENTION

Figure 6:
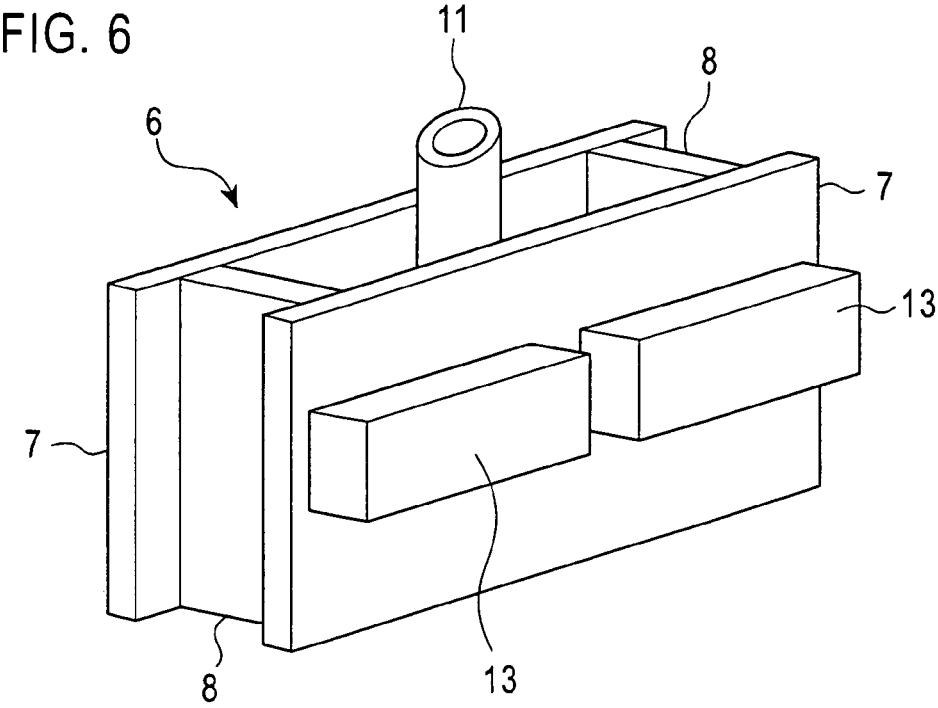
FIG. 6 is a schematic view of a slab continuous casting machine used in the application of the present invention, and specifically is a schematic perspective view of a mold portion.
Figure 7:
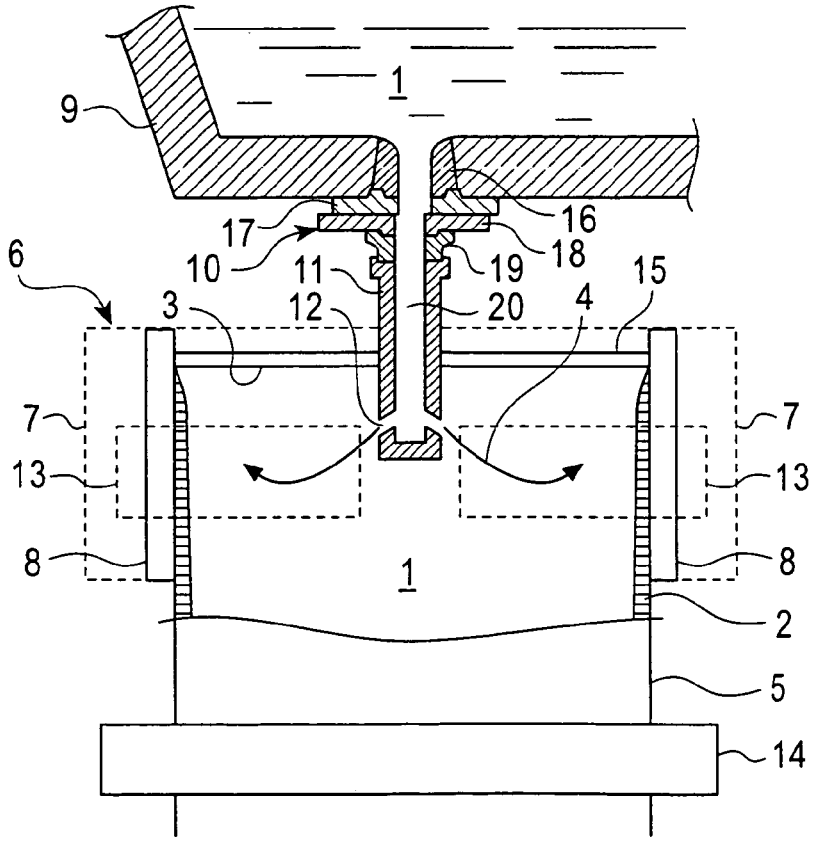
FIG. 7 is a schematic view of the slab continuous casting machine used when carrying out the present invention and specifically is a schematic front view of the mold portion.
Figure 8:
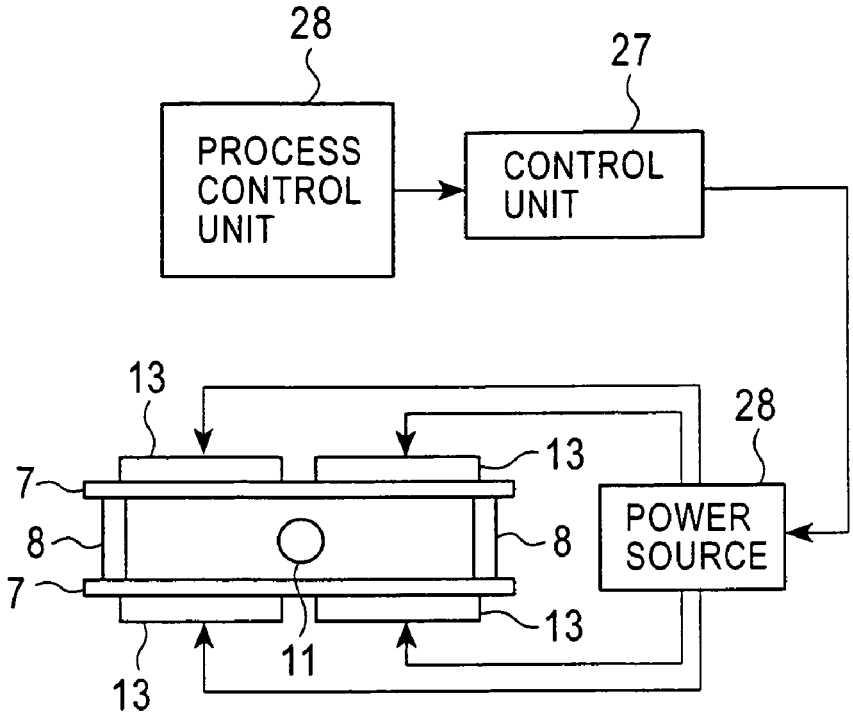
FIG. 8 is a schematic view of the slab continuous casting machine used when carrying-out the present invention and specifically is a schematic configuration view of a magnetic-field control facility for controlling a magnetic field that is to be applied.

[1] Embodiments of the present invention will be described hereinbelow with reference to the accompanying drawings. FIGS. 6 to 8 are each a schematic view of a slab continuous casting machine used in carrying out the present invention. More specifically, FIG. 6 is a schematic perspective view of a mold portion; FIG. 7 is a schematic front view of the mold portion; and FIG. 8 is a schematic configuration view of a magnetic field control facility used to control magnetic fields that are to be applied.

[2] Referring to FIGS. 6 to 8, a tundish 9 is disposed in a predetermined position over a mold 6 that has mutually opposite mold long sides 7 and mutually opposite mold short sides 8 internally provided between the mold long sides 7. An upper nozzle 16 is situated in a bottom portion of the tundish 9. A sliding nozzle 10 formed of a fixed plate 17, a slide plate 18, and a straightening nozzle 19 is disposed in contact with an undersurface of the upper nozzle 16. In addition, an immersion nozzle 11 having a pair of discharge openings 12 in a lower portion is disposed in contact with an undersurface of the sliding nozzle 10. A molten steel outflow opening 20 is formed for the molten steel outflow from the tundish 9 to the mold 6. For the prevention of alumina adherence to an inner wall of the immersion nozzle 11, an inert gas such as an Ar gas or a nitrogen gas is injected into the molten steel outflow opening 20 through, for example, the upper nozzle 16, the fixed plate 17, and the immersion nozzle 11.

[3] On the rear surfaces of the mold long sides 7, four shifting magnetic field generating apparatuses 13 in total are disposed in separation into two opposite sides in the left and right with respect to the immersion nozzle 11 as a boundary in the width direction of each of the mold long sides 7. The generators on the individual sides are thus disposed with the mold long sides 7 being interposed to have a center position in a casting direction thereof as an immediate-downstream position of the discharge openings 12. The individual shifting magnetic field generating apparatuses 13 are connected to a power supply 28. The power supply 28 is connected to a control unit 27 that controls the magnetic field movement direction and the magnetic field intensity. The magnetic field intensity and the magnetic field movement direction are independently controlled by electric power supplied from the power supply 28 in accordance with the magnetic-field movement direction and magnetic field intensity having been input from the control unit 27. The control unit 27 is connected to a process control unit 26 that controls continuous casting, whereby to control, for example, timing of magnetic field application in accordance with operation information sent from the process control unit 26.

Figure 9:
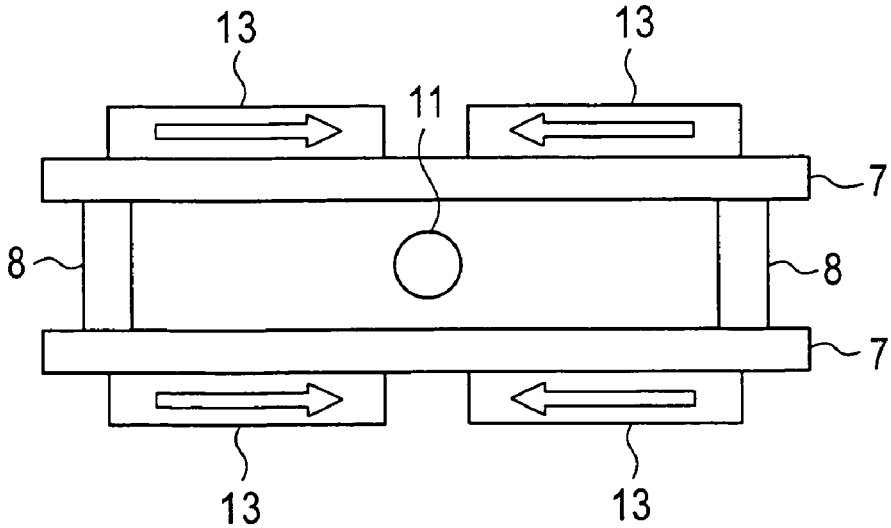
FIG. 9 is a view of movement directions of the magnetic field in an EMLS mode, as viewed from a position just above the mold.
Figure 10:
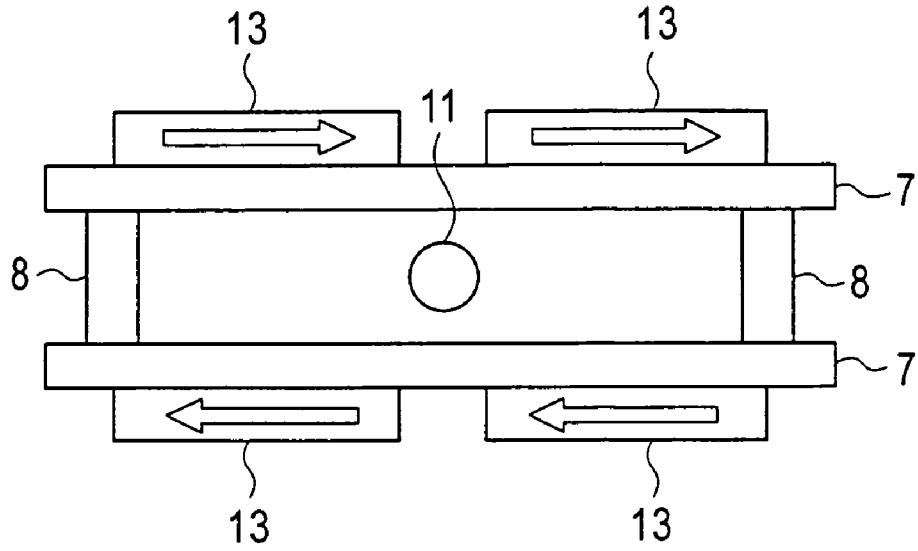
FIG. 10 is a view of movement directions of the magnetic field in an EMRS mode, as viewed from the position just above the mold.
Figure 11:
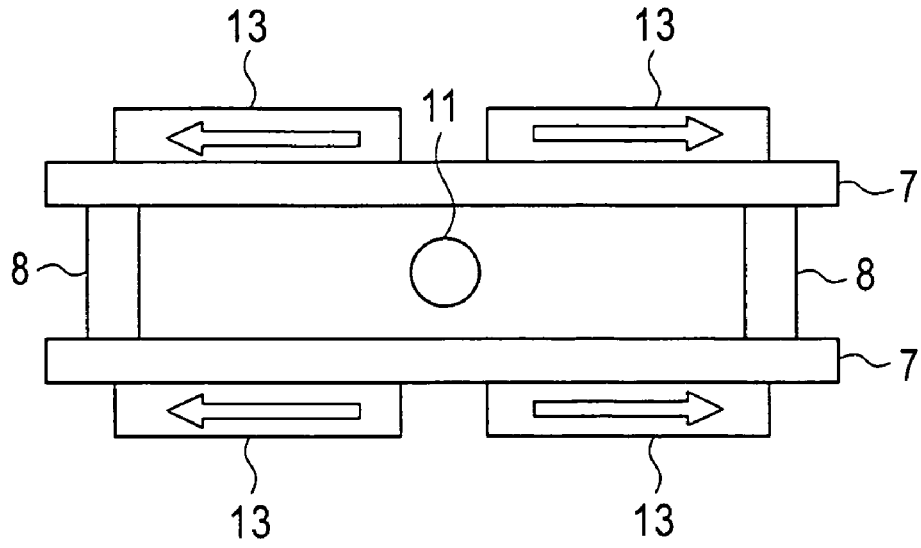
FIG. 11 is a view of movement directions of the magnetic field in an EMLA mode, as viewed from the position just above the mold.

[4] The magnetic field to be applied by the shifting magnetic field generating apparatus 13 is the shifting magnetic field. As shown in FIG. 9, in the event of EMLS-mode magnetic field application for imparting the braking force to the molten steel discharge flow 4 from the immersion nozzle 11, the movement directions of the shifting magnetic field are set to the immersion nozzle 11 side from the mold short sides 8 side. In the event of EMRS-mode magnetic field application for inducing molten steel flow such as rotating in the horizontal direction on the solidifying surface, as shown in FIG. 10, the movement directions of the shifting magnetic field are set opposite to each other along the mold long sides 7 opposite to each other. In the event of EMLA-mode magnetic field application for imparting the accelerating force to the molten steel discharge flow 4 discharged from the immersion nozzle 11, as shown in FIG. 11, the movement directions of the shifting magnetic field are set to the mold short sides 8 side from the immersion nozzle 11 side. According to FIG. 10, although the shifting magnetic field is set to a movement mode such as rotating clockwise, advantages are the same even when the magnetic field moves counterclockwise. Meanwhile, FIGS. 9, 10, and 11 respectively are views of the movement directions of the magnetic field being applied according to the EMLS, EMRS, and EMLA modes, as viewed from a position just above the mold 6, in which the arrows indicate the movement directions of the magnetic field.

In lower portions of the mold 6, there are situated a plurality of guide rolls (not shown) for supporting a cast product 5 that is to be produced by casting and a plurality of pinch rolls 14 (not shown) for withdrawing the cast product 5. In FIG. 7, only one of the pinch rolls 14 is shown, and other pinch rolls are omitted.

[5] With the continuous casting machine thus constructed, the operation of casting is performed in a manner described below to cast-produce the cast product 5 of high quality with less inclusions entrapped on the surface layer of the cast product 5.

[6] Molten steel is poured from a pan (not shown) into a tundish 9. When the molten steel amount reaches a predetermined amount, the slide plate 18 is opened to allow the molten steel 1 to be poured into the mold 6 through the molten steel outflow opening 20. The molten steel 1 forms the molten steel discharge flow 4 proceeding to the mold short sides 8, and is then poured into the mold 6 from the discharge openings 12 immersed in the molten steel 1 in the mold 6. The molten steel 1 poured into the mold 6 is cooled by the mold 6, thereby forming a solidifying shell 2. When a predetermined amount of the molten steel 1 has been poured into the mold 6, the operation starts withdrawal of the cast product 5 containing unsolidified molten steel 1 in its inside with an outer shell as the solidifying shell 2. After the withdrawal is started, while the position of a molten steel bath surface 3 is being controlled to a substantially constant position in the mold 6, and the casting speed is increased to a predetermined casting speed. A mold powder 15 is then added to the molten steel bath surface 3 in the mold 6. The mold powder 15 is melted, thereby exhibiting the effect of, for example, preventing oxidation of the molten steel 1. Concurrently, the molten mold powder 15 flows between the solidifying shell 2 and the mold 6 and thereby exhibits an effect as a lubricant.

[7] In the casting operation, the molten-steel flow velocities in the mold short-side vicinity on the molten steel bath surface 3 are determined corresponding to the individual casting conditions. One of the methods for determining the molten steel flow velocity is of a type that predicts the molten steel flow velocity on the molten steel bath surface 3 by using the above-described Equation (4) in accordance with the each individual casting condition. In this case, since the flow velocity can be theoretically predicted, actual measurement need not be preformed, various conditions are quickly addressable, and as such is a preferable method for determining the molten steel flow velocity.

[8] Another method is of a type that actually measures the molten steel flow velocity on the molten steel bath surface 3. When a casting condition has been determined and set, the molten steel flow velocity on the molten steel bath surface 3 is substantially constant under that condition. As such, when molten steel flow velocities in the molten steel bath surface 3 under the individual casting conditions are preliminarily measured, the flow velocity can be determined from the corresponding casting condition. In this case, the actual measurement value of the molten steel flow velocity may be preserved, and the preserved actual measurement value of the molten steel flow velocity may be determined as the molten steel flow velocity. The molten steel flow velocity can be measured in such a manner that a thin rod of a refractory material is immersed in the molten steel bath-surface 3, and the flow velocity can be measured form kinetic energy received by the thin rod.

In the event that the molten-steel flow velocity in the mold short-side vicinity on the molten steel bath surface 3 is lower than or equal to the inclusion-adherence critical flow velocity, more specifically, lower than 0.20 m/sec, the shifting magnetic field is applied according to the EMRS or EMLA mode. In the event that the molten-steel flow velocity in the mold short-side vicinity on the molten steel bath surface 3 is higher than the mold-powder entrainment critical flow velocity, more specifically, higher than 0.32 m/sec, the shifting magnetic field is applied according to the EMLS mode.

Further, in the event that the molten-steel flow velocity in the mold short-side vicinity on the molten steel bath surface 3 is less than the inclusion-adherence critical flow velocity, the application process for the shifting magnetic field is separated into two sub-processes. In the event that the above-described molten steel flow velocity is less than the bath-surface skinning critical flow velocity, more specifically, lower than 0.10 m/sec, the shifting magnetic field is preferably applied according to the EMLA mode. In the event that the above-described molten steel flow velocity is less than the inclusion-adherence critical flow velocity and concurrently higher than or equal to the bath-surface skinning critical flow velocity, more specifically, 0.10 m/sec or higher and lower than 0.20 m/sec, the shifting magnetic field is preferably applied according to the EMRS mode.

[1] The magnetic flux density of the shifting magnetic field is set in the following manners. For the application of the shifting magnetic field to rotate the molten steel 1 in the mold 6 in the horizontal direction, the density is set in accordance with the above-described Equation (1). For the application of the shifting magnetic field to impart the accelerating force to the molten steel discharge flow 4 discharged from the immersion nozzle 11, the density is set in accordance with the above-described Equation (2). For the application of the shifting magnetic field to impart the braking force to the molten steel discharge flow 4 discharged from the immersion nozzle 11, the density is set in accordance with the above-described Equation (3). After the application of the shifting magnetic field, the target value of the molten-steel flow velocity in the mold short-side vicinity on the molten steel bath surface 3 is set to 0.25 m/sec.

Figure 12:
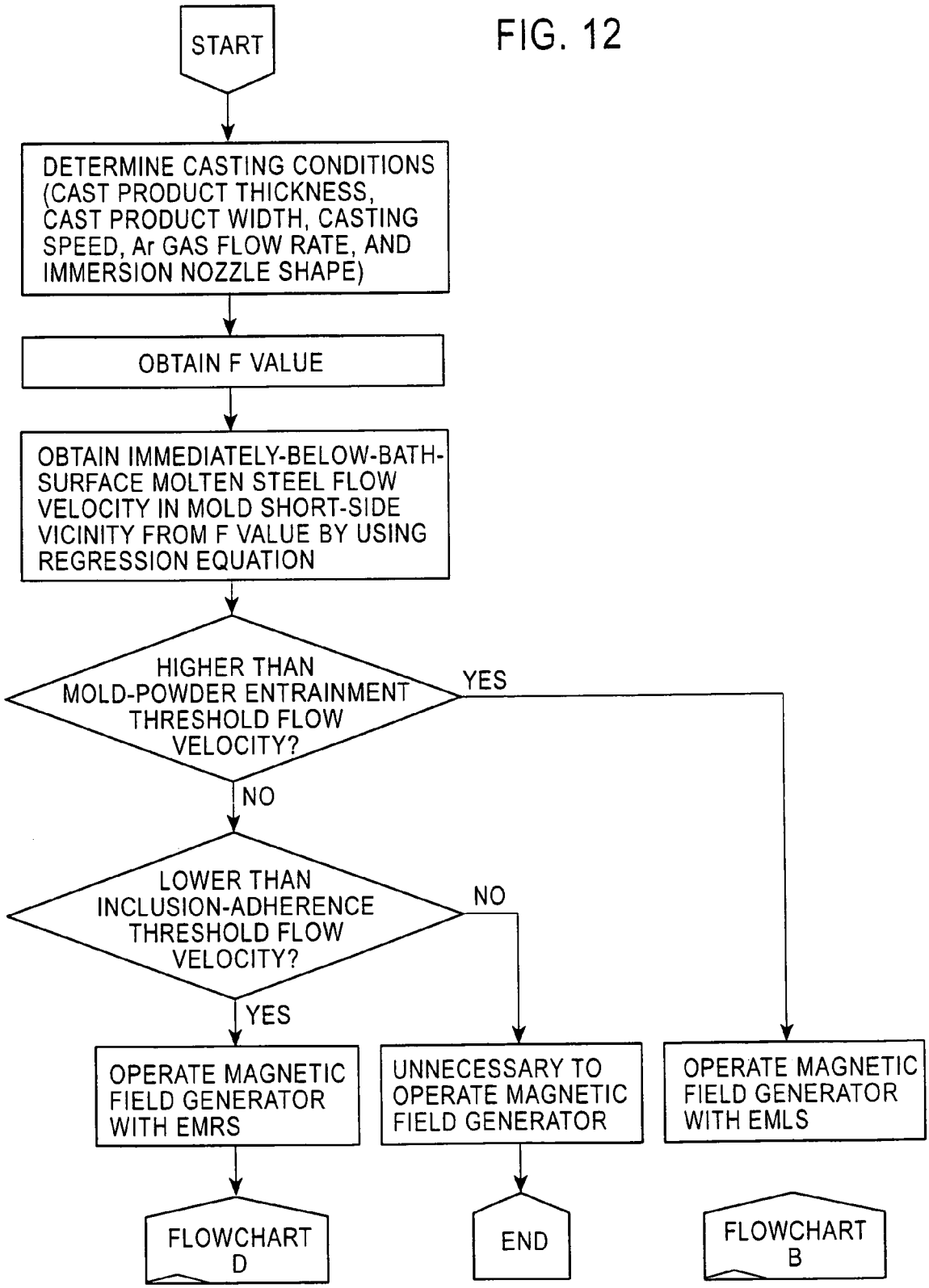
FIG. 12 is a view showing an embodiment of the present invention, and specifically is a flowchart corresponding to the event that the magnetic field is applied according to the EMRS mode when the molten steel flow velocity in the mold short-side vicinity according to the F value is lower than an inclusion-adherence critical flow velocity.
Figure 13:
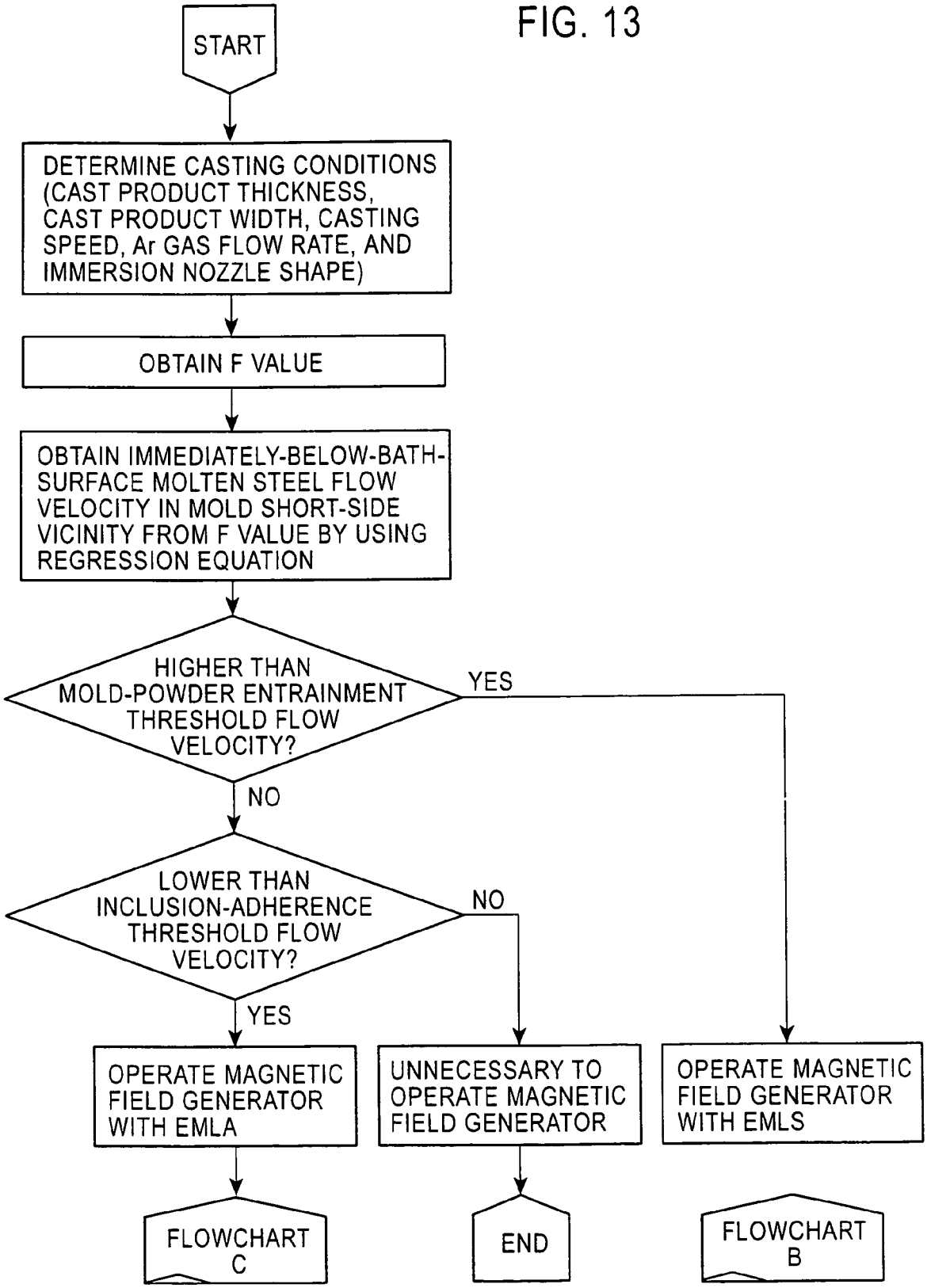
FIG. 13 is a view showing the embodiment of the present invention, and specifically is a flowchart corresponding to the event that the magnetic field is applied according to the EMLA mode when the molten steel flow velocity in the mold short-side vicinity according to the F value is lower than the inclusion-adherence critical flow velocity.
Figure 14:
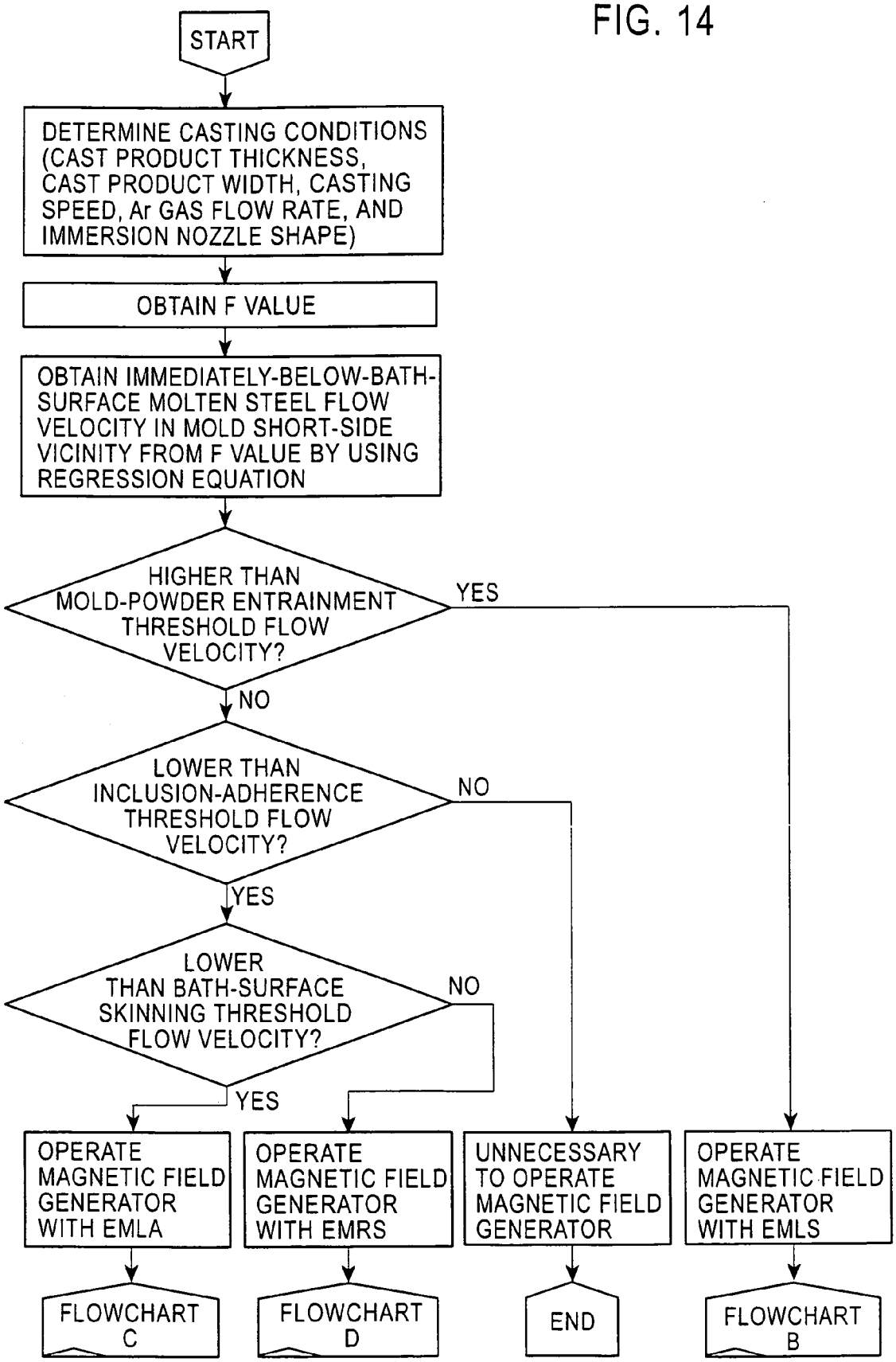
FIG. 14 is a view showing the embodiment of the present invention, and specifically is a flowchart corresponding to the event that the magnetic field is applied according to the EMLA mode when the molten steel flow velocity in the mold short-side vicinity according to the F value is lower than a bath-surface skinning critical flow velocity, and the magnetic field is applied according to the EMRS when the molten steel flow velocity in the mold short-side vicinity on the intra-mold molten steel bath surface according to the F value is lower than the inclusion-adherence critical flow velocity and specifically is higher than or equal to bath-surface skinning critical flow velocity.
Figure 15:
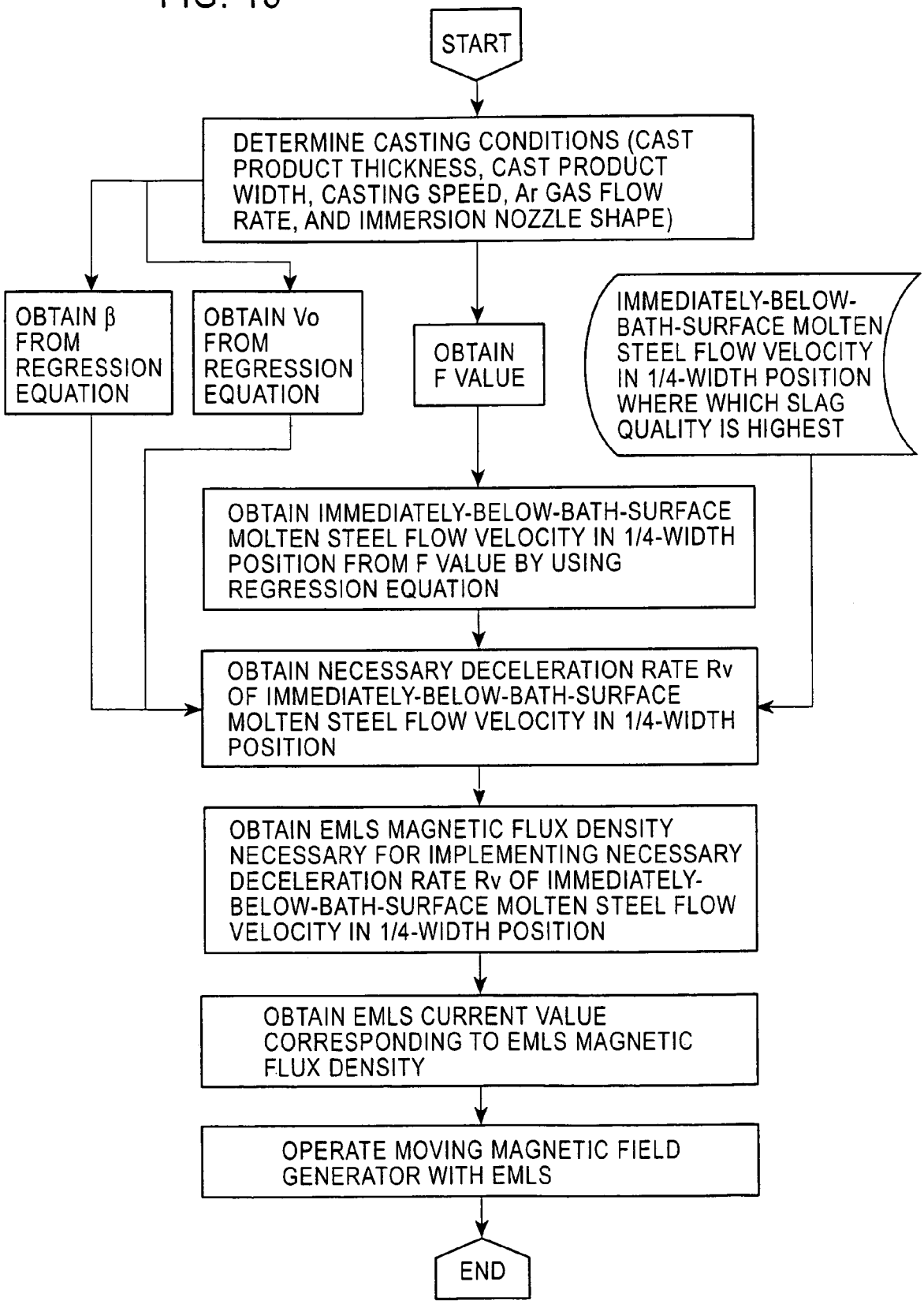
FIG. 15 is a view showing the embodiment of the present invention, and specifically is a flowchart showing a magnetic-flux-density determining process when the magnetic field is applied according to the EMLS mode is conducted.
Figure 16:
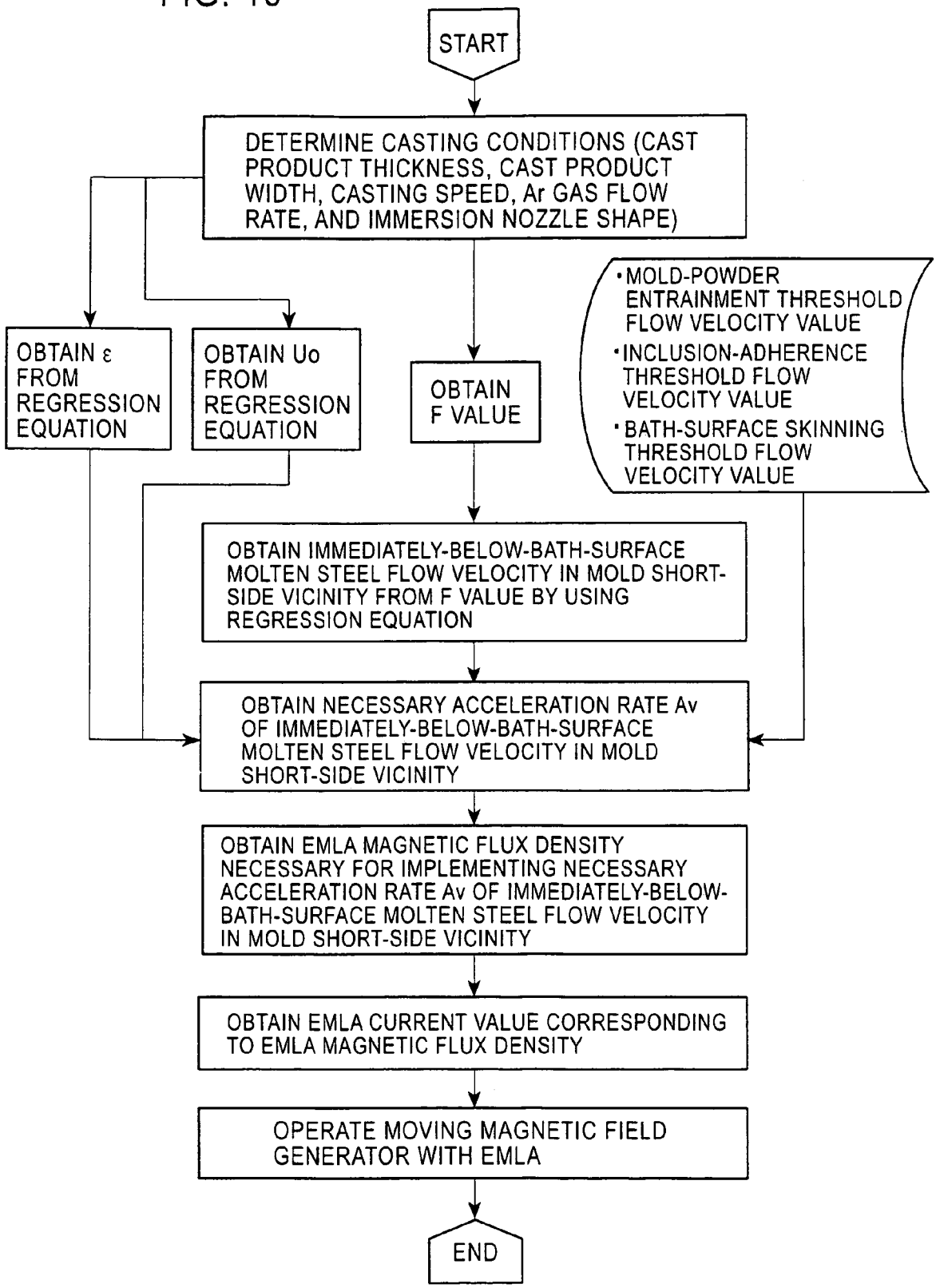
FIG. 16 is a view showing the embodiment of the present invention, and specifically is a flowchart showing a magnetic-flux-density determining process when the magnetic field is applied according to the EMLA mode.
Figure 17:
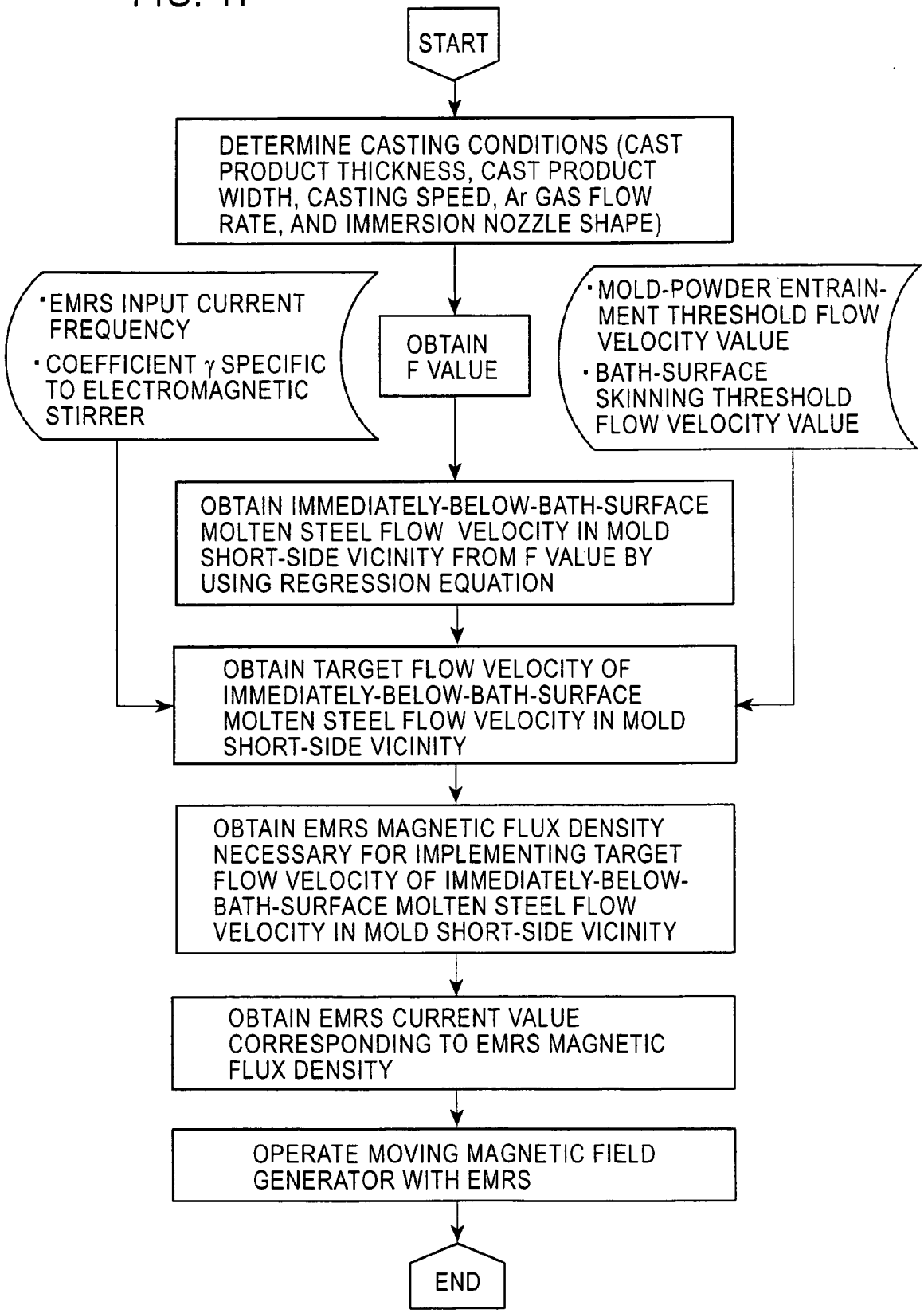
FIG. 17 is a view showing the embodiment of the present invention, and specifically is a flowchart showing a magnetic-flux-density determining process when the magnetic field is applied according to the EMRS mode.

[2] FIGS. 12 to 17 individually show flowcharts for applying the shifting magnetic field in the above-described manners. Specifically, FIG. 12 is a flowchart (flowchart A-1) corresponding to the event in which the magnetic field is applied according to the EMRS mode when the molten-steel flow velocity in the mold short-side vicinity according to the F value is lower than the inclusion-adherence critical flow velocity. FIG. 13 is a flowchart (flowchart A-2) corresponding to the event in which the magnetic field is applied according to the EMLA mode when the molten-steel flow velocity in the mold short-side vicinity according to the F value is lower than the inclusion-adherence critical flow velocity. FIG. 14 is a flowchart (flowchart A-3) corresponding to the event in which the magnetic field is applied according to the EMLA mode when the molten-steel flow velocity in the mold short-side vicinity according to the F value is lower than the bath-surface skinning critical flow velocity, and the magnetic field is applied according to the EMRS mode when the molten-steel flow velocity in the mold short-side vicinity according to the F value is lower than the inclusion-adherence critical flow velocity and concurrently higher than or equal to the bath-surface skinning critical flow velocity. FIG. 15 is a flowchart (flowchart B) showing a determining process for the magnetic flux density when applying the magnetic field according to the EMLS mode. FIG. 16 is a flowchart (flowchart C) showing a determining process for the magnetic flux density when applying the magnetic field according to the EMLA mode. FIG. 17 is a flowchart (flowchart D) showing the determining process for the magnetic flux density when applying the magnetic field according to the EMLS mode.

[3] As shown in FIGS. 12 to 14, in accordance with information of casting conditions including the cast product thickness, cast product width, casting speed, injection quantity of the inert gas such as Ar gas into the molten steel outflow opening 20, and shape of the immersion nozzle 11 in use, an F value in the casting conditions is obtained by using the above-described Equation (5). Then, a molten-steel surface flow velocity in the mold short-side vicinity is obtained from the F value through calculation by using the above-described Equation (4). Then, the molten-steel surface flow velocity obtained by the calculation is compared with the mold-powder entrainment critical flow velocity, the inclusion-adherence critical flow velocity, and the bath-surface skinning critical flow velocity. Thereby, the shifting magnetic field to be applied corresponding to flow velocity segments is separated for the EMLS mode, the EMLA mode, and the EMRS mode. For the EMLS-mode magnetic field application, a necessary magnetic flux density is calculated to determine a predetermined current value, and the magnetic field is then applied in accordance with the flowchart B of FIG. 15. For the EMLA-mode magnetic field application, a necessary magnetic flux density is calculated to determine a predetermined current value, and the magnetic field is then applied in accordance with the flowchart C of FIG. 16. For the EMRS-mode magnetic field application, a necessary magnetic flux density is calculated to determine a predetermined current value, and the magnetic field is then applied in accordance with the flowchart D of FIG. 17.

[4] In this case, information retained in the process control unit 26 is input as the casting conditions to the control unit 27. The control unit 27 performs steps from the calculation step for the F value to the calculation step for the current value that is used to generate the predetermined magnetic flux density. In accordance with the magnetic field mode and current value having been input from the control unit 27, the power supply 28 supplies electric power to the shifting magnetic field generating apparatus 13. During casting, periodically or upon an alteration in the casting conditions, the control unit 27 acquires the type of shifting magnetic field and the magnetic flux density, and serially issues instructions indicative of the type of shifting magnetic field and the current value to the power supply 28. That is, even when the casting conditions are altered, the shifting magnetic field can be applied constantly at an optimal mode.

Figure 1:
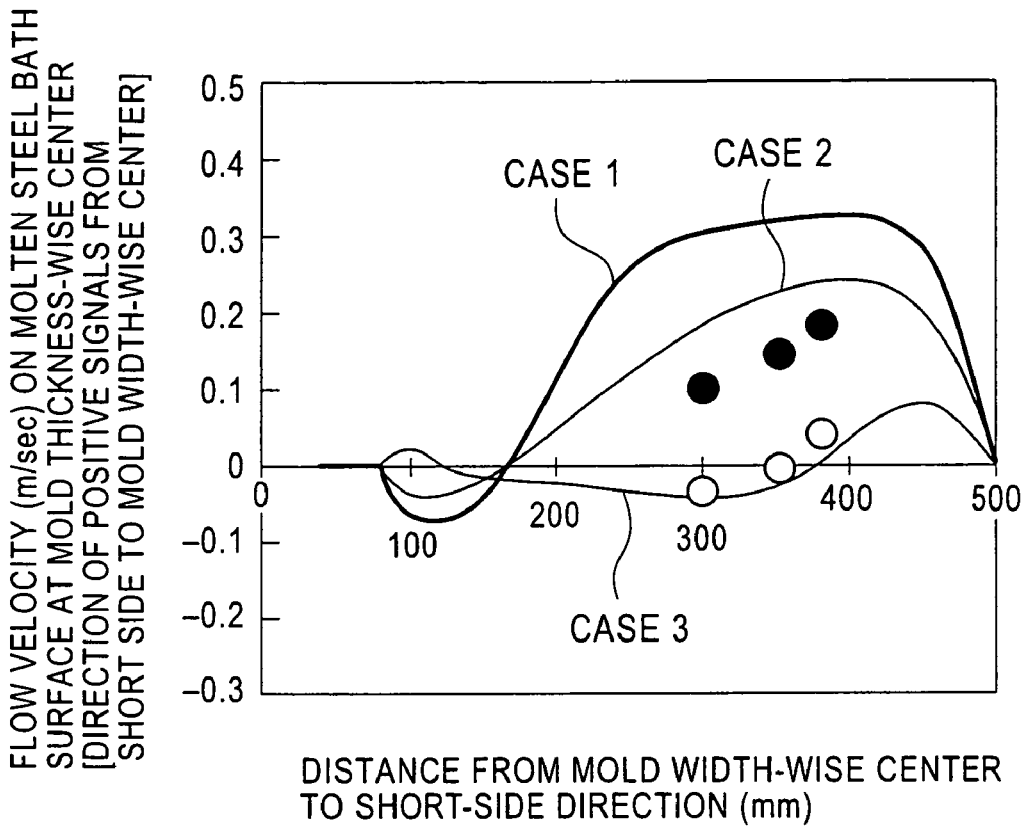
FIG. 1 is a view showing profiles in accordance with numeric fluid simulation of intra-mold molten steel bath surface flow velocities along a width direction at a mold-thickness-wise center.
Figure 2:
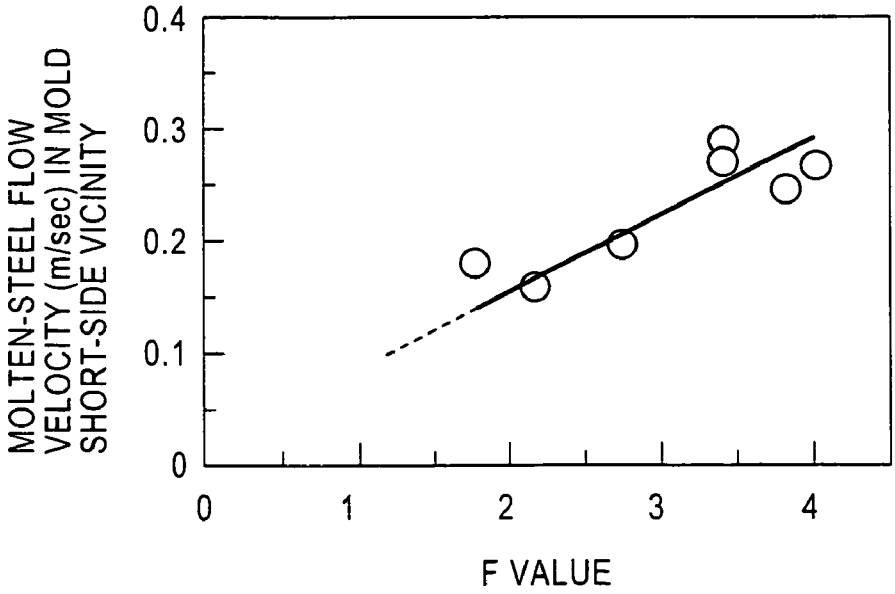
FIG. 2 is a view showing the relationship between a molten steel flow velocity in a mold short-side vicinity on an intra-mold molten steel bath surface, which velocity was measured in an actual facility, and an F value under casting conditions thereof.
Figure 3:
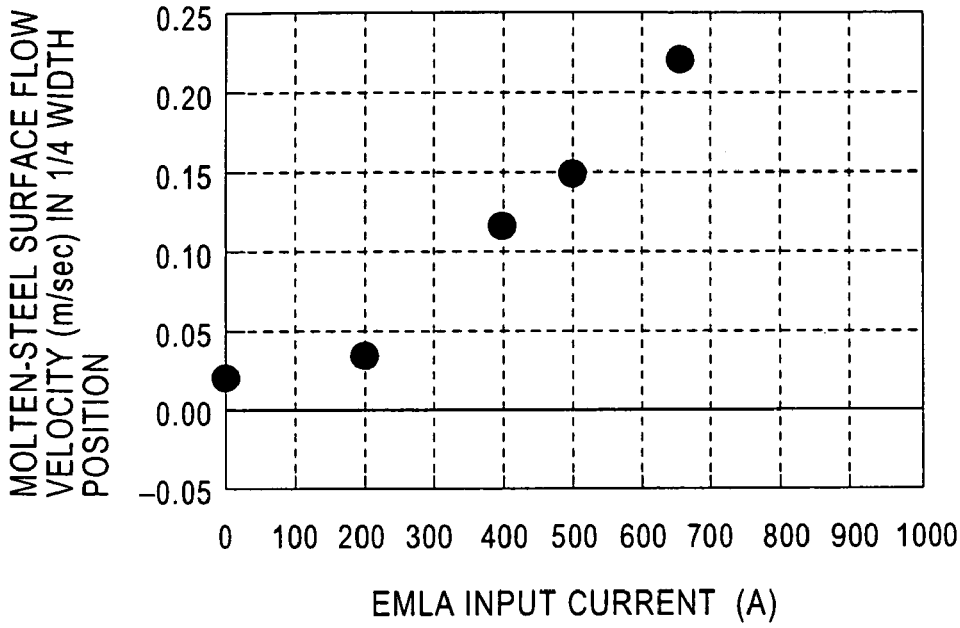
FIG. 3 is a view showing the relationship between an EMLA input current and the molten steel surface flow velocity measured in the actual facility.
Figure 4:
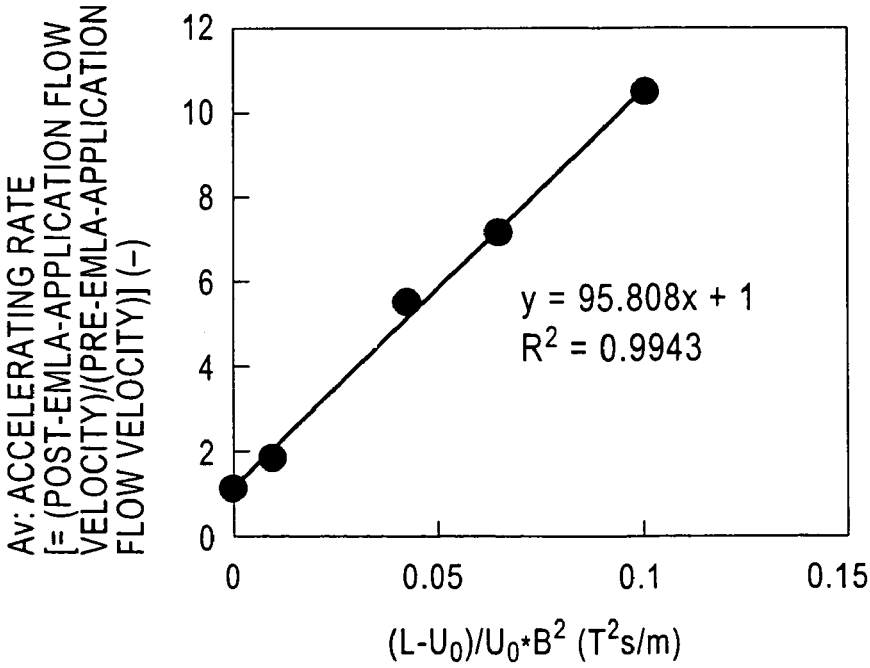
FIG. 4 is a view showing a result derived from replotting plots of FIG. 3 in accordance with parameters of Equation (2).
Figure 5:
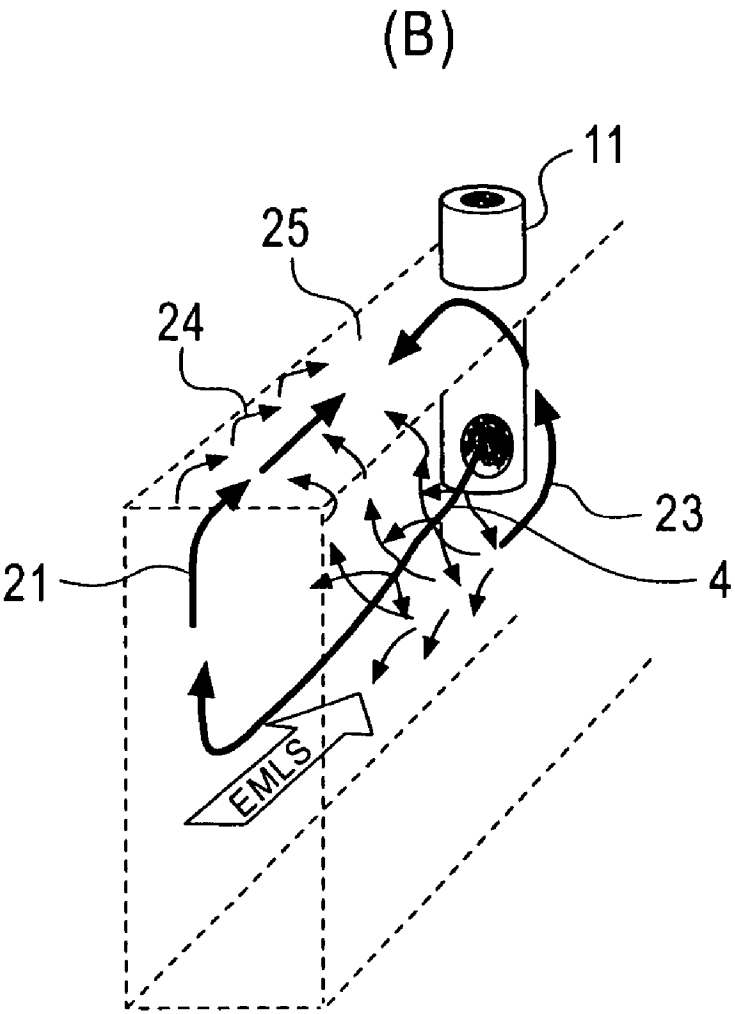
FIG. 5 is a view schematically showing intra-mold molten steel flows, in which (A) is a view showing a state without a magnetic field being applied, and (B) is a view showing a state with EMLS application.
Figure 5:
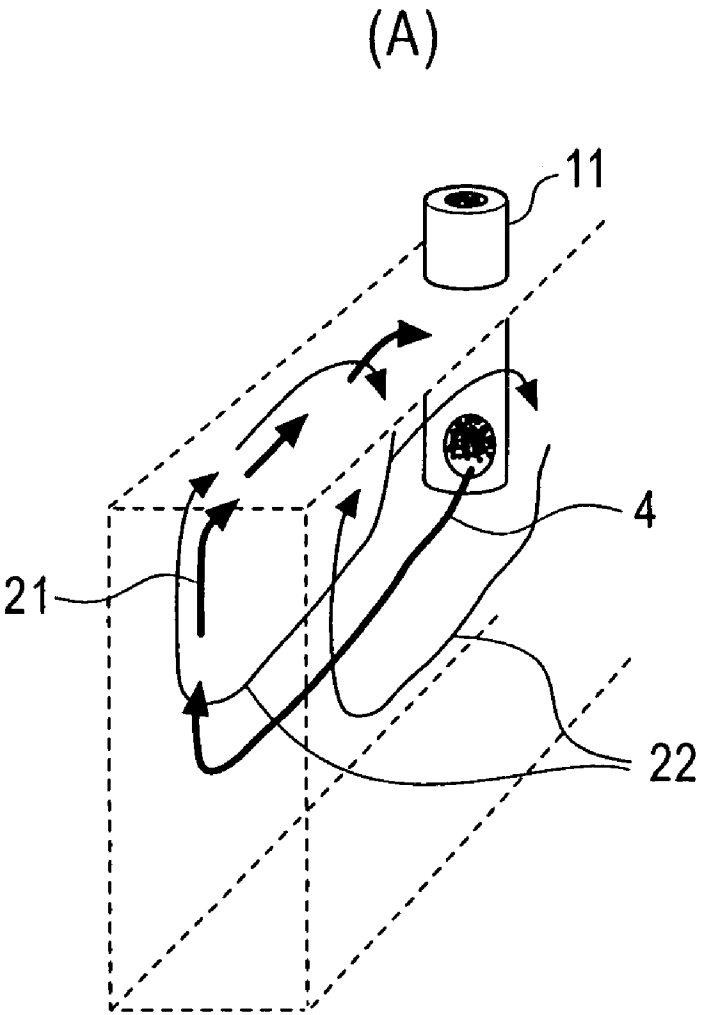

[5] According to FIGS. 12 to 14, the F value is converted into the molten-steel surface flow velocity. However, as described above, the F value and the molten steel flow velocity have the one-to-one relationship, so that the control can be performed by using the F value without conversion into the molten-steel surface flow velocity. FIG. 15 has a description saying as "OBTAIN IMMEDIATELY-BELOW-BATH-SURFACE MOLTEN STEEL FLOW VELOCITY IN ¼-WIDTH POSITION FROM F VALUE BY USING REGRESSION EQUATION". In this case, Equation (4) described above is used to obtain the molten-steel flow velocity in the mold short-side vicinity. As such, when obtaining the immediately-below-bath-surface molten steel flow velocity in the ¼ width position, the velocity can be obtained by altering the coefficient k of Equation (4). As shown in FIG. 1, there is the correlation between the immediately-below-bath-surface molten steel flow velocity in the ¼-width position and the molten-steel flow velocity in the mold short-side vicinity, so that also the immediately-below-bath-surface molten steel flow velocity in the ¼-width position can be obtained from the F value.

[6] According to the magnetic field application process described above, the shifting magnetic field is not applied when the molten-steel flow velocity in the mold short-side vicinity falls in a range of a level higher than or equal to the inclusion-adherence critical flow velocity to a level lower than or equal to the mold-powder entrainment critical flow velocity. However, the shifting magnetic field is preferably applied in the range described above.

[7] That is, as described above, preferably, the optimal flow velocity value (=0.25 m/sec) as a quality factor of the cast product is provided for the molten steel flow velocity on the intra-mold molten steel bath surface, and the molten steel flow velocity is controlled to constantly become the optimal flow velocity value. Accordingly, suppose that the molten-steel flow velocity in the mold short-side vicinity on the molten steel bath surface is higher than or equal to the inclusion-adherence critical flow velocity and concurrently lower than the optimal flow velocity value. In this case, the magnetic field is applied in the EMRS or EMLA mode to control the molten-steel surface flow velocity to the optimal flow velocity value. On the other hand, suppose that the molten-steel flow velocity in the mold short-side vicinity on the molten steel bath surface is higher than the optimal flow velocity value and concurrently lower than the mold-powder entrainment critical flow velocity. In this case, the magnetic field is applied in the EMLS mode to control the molten-steel surface flow velocity to the optimal flow velocity value. In this case, as the molten-steel flow velocity in the mold short-side vicinity on the molten steel bath surface approaches the optimal flow velocity value, the magnetic flux density of the magnetic field to be applied should be controlled to be low. When performing the control in accordance with the F value by using the above-described application process, the molten steel flow velocity can be controlled by using a flowchart created by replacing "MOLD-POWDER ENTRAINMENT CRITICAL FLOW VELOCITY" with "OPTIMAL FLOW VELOCITY VALUE.".

Figure 18:
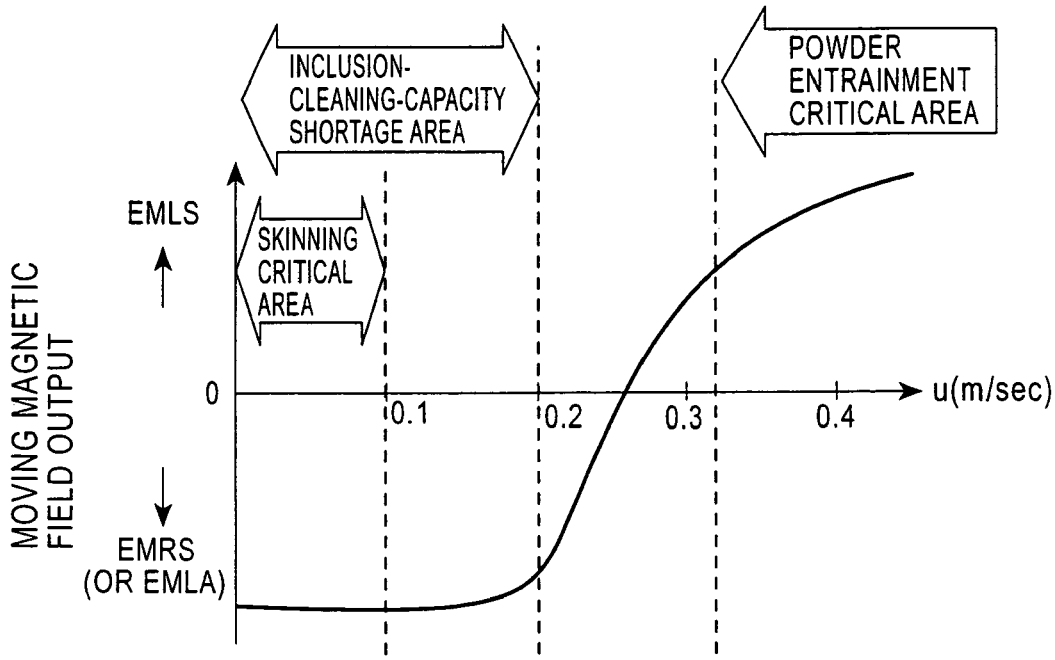
FIG. 18 is a schematic view of a method of performing flow control of intra-mold, molten steel according to the present invention.

[8] FIG. 18 is a schematic view of a method of performing flow control of intra-mold molten steel according to the above-described concepts. As described above, in the event that the molten-steel flow velocity in the mold short-side vicinity on the molten steel bath surface 3 is in the range of from 0.20 m/sec or higher to 0.32 m/sec or lower, the shifting magnetic field need not be applied. However, as shown in FIG. 18, to control the target value of the molten steel flow velocity to the optimal flow velocity value of 0.25 m/sec, in the event that the molten-steel flow velocity in the mold short-side vicinity on the molten steel bath surface 3 falls in the range of from 0.20 m/sec or higher to lower-than 0.25 m/sec, the shifting magnetic field may be applied in the EMLS mode. In addition, in the event that the molten-steel flow velocity falls in the range of from higher-than 0.25 m/sec to 0.32 or lower, the shifting magnetic field may be applied in the EMLS mode. In this case, as the molten steel flow velocity approaches the target value of 0.25 m/sec, the magnetic field intensity is controlled to below.

[9] In the manner described above, by continuously casting the molten steel 1 while controlling the molten steel flow in the mold 6, the cast product 5, a clean, high quality cast product 5 can be steadily produced by casting even over a wide range of casting speeds not only with very small amounts of substances such as deoxidation products and Ar gas bubbles but also with a very small amount of entrainment of the mold powder 15.

In the above, description has been made with reference to the example configuration with the sliding nozzle 10 formed of two plates. However, the present invention may be adapted along the above to a configuration with a sliding nozzle formed of three plates. Further, the present invention may be applied along the above to a stopper-type configuration.

EXAMPLES

Casting was performed by using the slab continuous casting machine shown in FIGS. 6 to 8 under conditions where the casting speed was changed to four levels, specifically, under four level conditions with the EMRS-mode magnetic field application, EMLS-mode magnetic field application, EMLA-mode magnetic field application, non-magnetic-field application. Then, investigations were conducted regarding influences of the magnetic field application on the cast product surface quality. Specifications of the used continuous casting machine are shown in Table 2, and attribute items of a used shifting magnetic field generating apparatus are shown in Table 3. For the casting, low-carbon Al killed steel was subjected, and the composition thereof contains—C: 0.03-0.05 mass %; Si: 0.03% or lower; Mn: 0.02-0.03 mass %; P: 0.020 mass % or lower; sol. Al: 0.03-0.06 mass %; and N: 0.03-0.006 mass %.

TABLE 2

| Item | Specifications |
|---|---|
| Continuous casting machine type | Vertical bent type |
| Vertical portion length | 2.5 m |
| Pan molten steel capacity | 300 tons |
| Tundish molten steel capacity | 80 tons |
| Cast product thickness | 235 mm |
| Cast product width | 700-1650 mm |
| Casting speed | 3.0 m/min maximum |
| Immersion nozzle | Downward 25°; Discharge opening 80 Φ |

TABLE 3

| | |
|---|---|
| Magnetic field type | Linear motor type |
| Power capacity | 2000 kVA-AC/Strand |
| Voltage | Max 430 V |
| Current | Max 2700 A |
| Frequency | 0-2.6 Hz |

The molten-steel flow velocity (u) in the mold short-side vicinity on the molten steel bath surface was predicted in accordance with Equation (4) described above. To obtain the molten steel flow velocity on the intra-mold molten steel bath surface from Equation (4), the velocity (Ve), angle (θ), and distance (D) must be obtained. In the present example, these parameters were obtained as described hereunder.

The velocity (Ve) was obtained from Equation (13), given below, that was derived by performing multi-regression analysis of results of water modelling experiments for molten-steel discharge flow profiles. In Equation (13), W is a cast product total width (mm); $Q_L$ is a molten steel pouring amount ($m^3$/sec) per unit time; d is a discharge opening diameter (m); α is an immersion-nozzle discharge angle (deg); $Q_g$ is an Ar gas injection amount ($Nm^3$/sec); and $A_1$, $B_1$, l, m, n, and p are individually constants of which values are shown in Table 4.

$$Ve=A_1\cdot(W/2)^1\cdot Q_L^m\cdot d^p\cdot(1/\cos\alpha)^n\cdot\exp(B_1\cdot Q_g) \quad (13)$$

TABLE 4

| | Constant | | | | | | | |
|---|---|---|---|---|---|---|---|---|
| | $a_1$ | $a_2$ | $b_1$ | $b_2$ | $c_1$ | $c_2$ | $d_1$ | $d_2$ |
| Numeric value | 0.0389 | −0.3202 | 0.0078 | 0.0305 | 18.37 | 107.33 | −0.1980 | −2.0679 |
| | Constant | | | | | | | |
| | $\zeta_1$ | $\zeta_2$ | $\xi_1^1$ | $\xi_1^2$ | $\xi_1^3$ | $\xi_1^4$ | $\xi_2^1$ | $\xi_2^2$ |
| Numeric value | 1.0 | 0.0120 | −1.5893 | 1.1371 | 1.195 | 1.633 | −1.5662 | 1.1647 |
| | Constant | | | | | | | |
| | $\xi_2^3$ | $\xi_2^4$ | $A_1$ | $B_1$ | l | M | N | p |
| Numeric value | 0.726 | 2.186 | 0.3716 | 100.9 | −0.651 | 0.745 | −0.507 | −1.165 |

The angle (θ) and the distance (D) were obtained from the molten-steel discharge flow profile. In the present case, first, the molten-steel discharge flow profile was obtained from Equation (14) given below that was obtained by performing multi-regression analysis of the results of water modeling experiments regarding molten-steel discharge flow profiles. In Equation (14), y is a vertical distance (m) with an immersion-nozzle opening outlet as the origin; x is a horizontal distance (m) with the immersion-nozzle opening outlet as the origin; α is the discharge angle (deg); S is an average discharge opening diameter (m); $a_1$, $a_2$, $b_1$, $b_2$, $c_1$, $c_2$, $d_1$, and $d_2$ are individually constants of which values are shown in Table 4; and $G_1$ and $G_2$ are individually numeric values determined by Equation (15) given below. In Equation (15), $Q_L$ is the molten steel pouring amount ($m^3$/sec) per unit time; $Q_g$ is the Ar gas injection amount ($Nm^3$/sec); and $\zeta_1$, $\zeta_2$, $\zeta_1^1$, $\zeta_1^2$, $\zeta_1^3$, $\zeta_1^4$, $\zeta_2^1$, $\zeta_2^2$, $\zeta_2^3$, and $\zeta_2^4$ are individually constants of which values are shown in Table 4.

$$y=(a_1+b_1\alpha c_1S+d_1\alpha S)G_1x^2-(a_1+b_1\alpha+c_1S+d_1+S)G_1x^2 \quad (14)$$

$$G_i=\exp((-\zeta_i\cdot Q_L^{\xi_i^1}\cdot Q_g^{\xi_i^2}\cdot S^{\xi_i^3}\cdot(90-\alpha)^{\xi_i^4})) \quad (15)$$

Then, the angle (θ) was obtained from a differential value in an x=W/2 position of the molten-steel discharge flow profile that was obtained from Equation (14). Then, the distance (D) was obtained in accordance with a y value in the x=W/2 position of the molten-steel discharge flow profile that was obtained from Equation (14). Calculation methods for the above are shown as Equations (16) and (17) given below. In Equation (17), h is a distance (m) from the intra-mold molten steel bath surface to a discharge-opening upper end.

$$\theta=\text{Arc tan}(-(dy/dx)|_{x=w/2}) \quad (16)$$

$$D=y|_{x=w/2}+h \quad (17)$$

The molten steel flow velocity (u) was calculated from thus-obtained velocity (Ve), angle (θ), and distance (D); the casting condition, and the molten steel density (7000 kg/$m^3$). The constant k was set to 0.036.

Table 5 shows casting conditions in individual test casting of Test Nos. 1 to 11. As shown in Table 5, testing conditions are broadly grouped into four levels A, B, C, and D. The level A represents a level in the event that the molten steel flow velocity on the intra-mold molten steel bath surface is excessively high or higher than the mold-powder entrainment critical flow velocity. In contrast, the levels B and D are each represents a level in the event that the molten steel flow velocity on the intra-mold molten steel bath surface is excessively low or lower than the inclusion-adherence critical flow velocity. Particularly, the level D is the level in the event that the molten steel flow velocity is even lower than the bath-surface skinning critical flow velocity.

Figure 19:
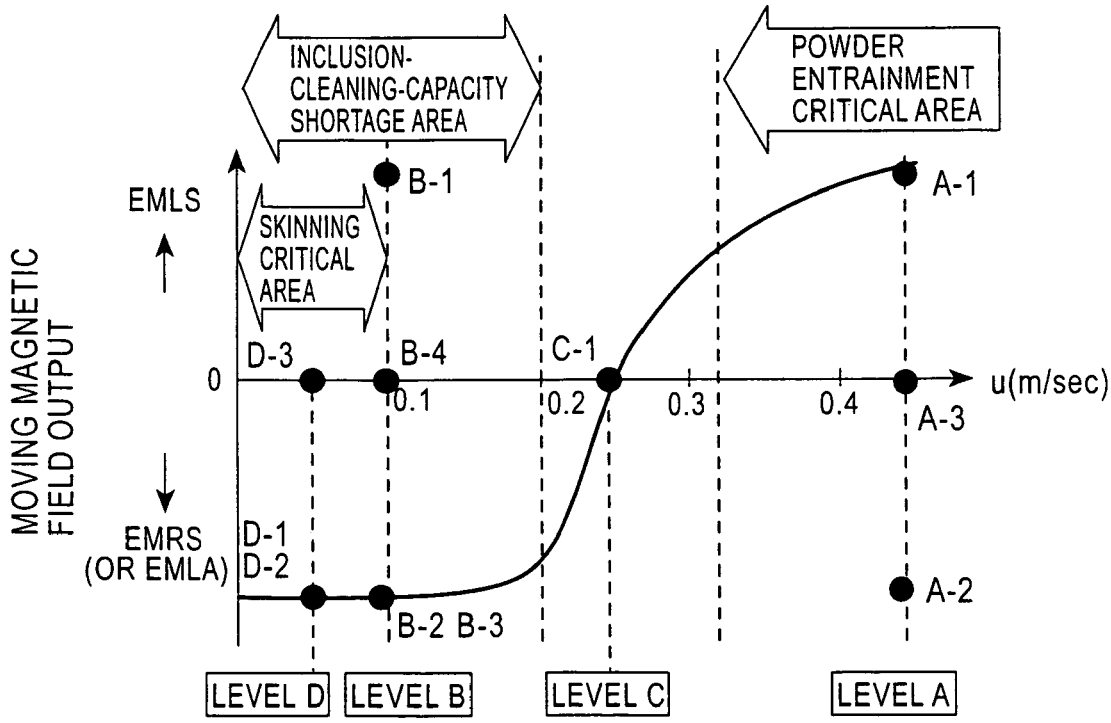
FIG. 19 is a schematic view created by overlapping testing conditions of the embodiment with FIG. 18.
Figure 20:
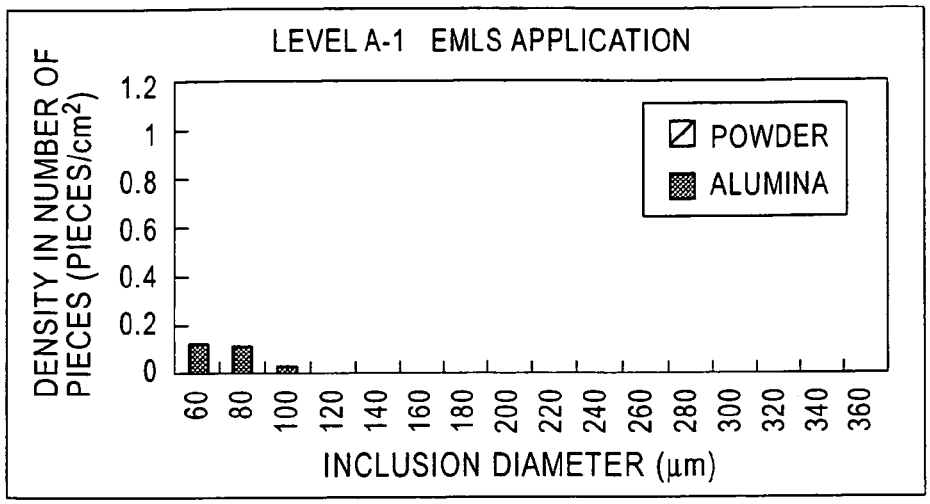
FIG. 20 is a view showing a cast product microscopy result at a level A-1 in an example.
Figure 21:
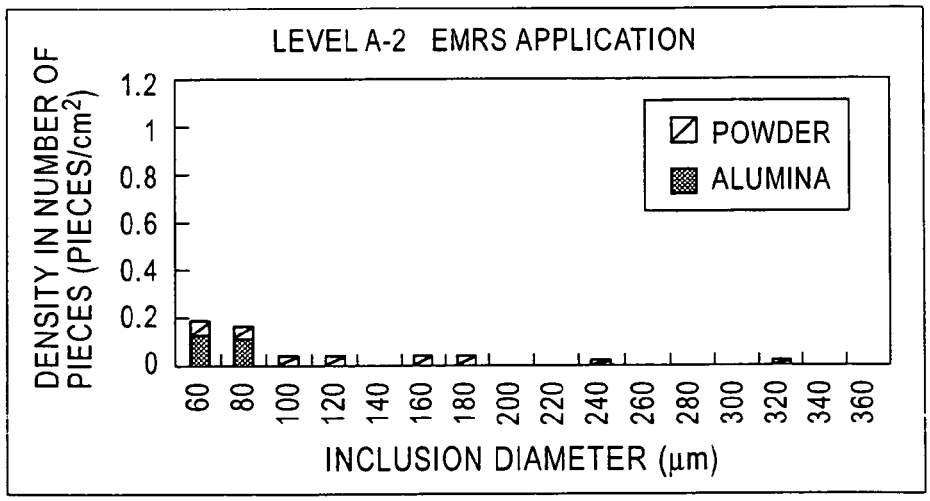
FIG. 21 is a view showing a cast product microscopy result at a level A-2 in an example.
Figure 22:
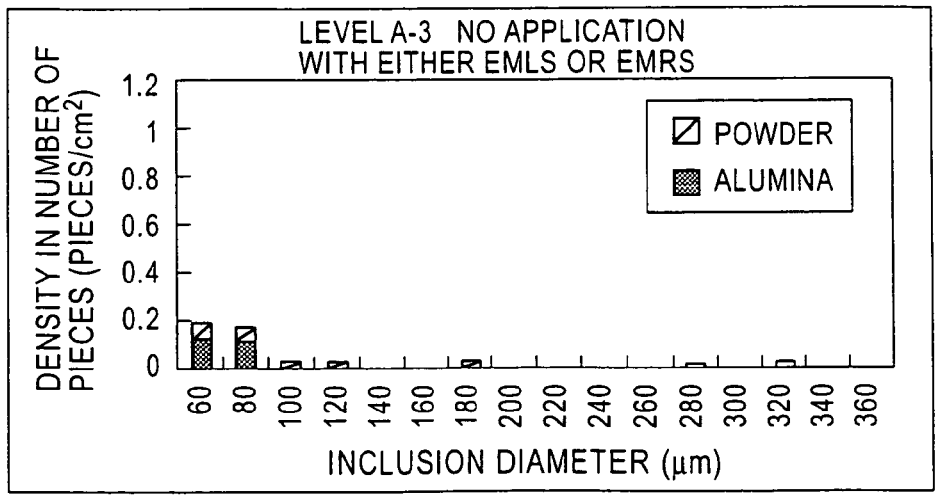
FIG. 22 is a view showing a cast product microscopy result at a level A-3 in an example.
Figure 23:
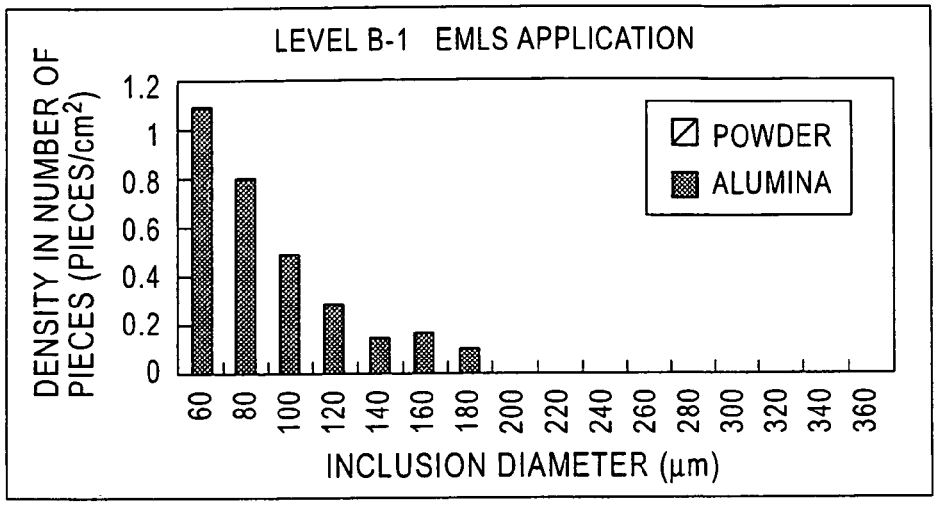
FIG. 23 is a view showing a cast product microscopy result at a level B-1 in an example.
Figure 24:
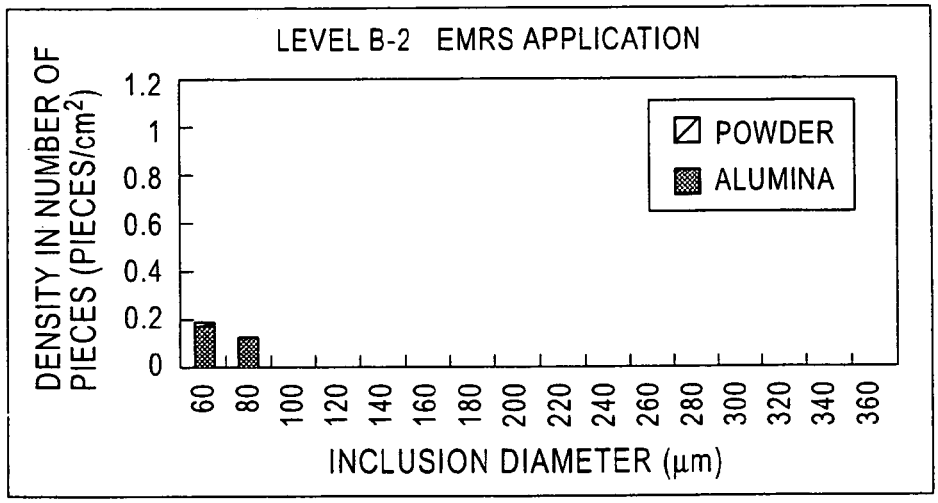
FIG. 24 is a view showing a cast product microscopy result at a level B-2 in an example.
Figure 25:
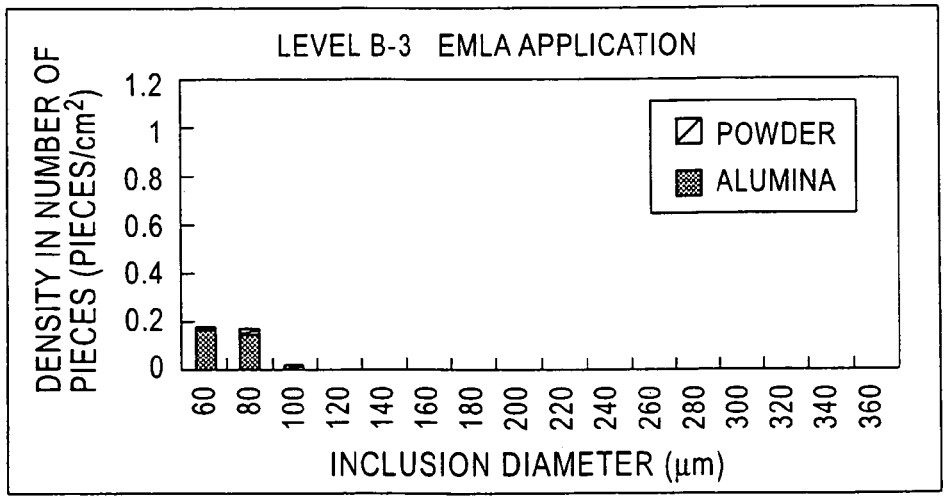
FIG. 25 is a view showing a cast product microscopy result at a level B-3 in an example.
Figure 26:
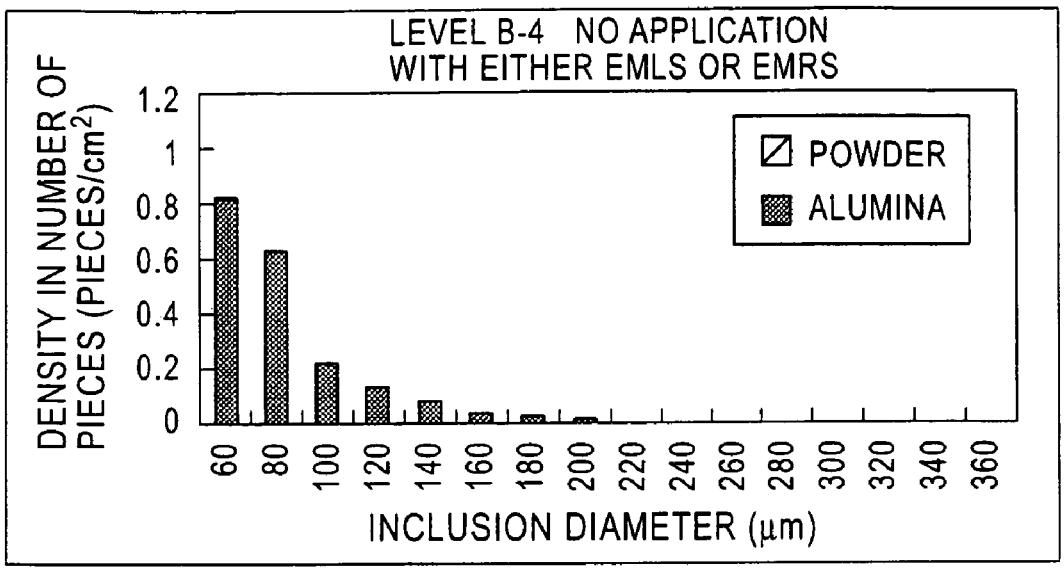
FIG. 26 is a view showing a cast product microscopy result at a level B-4 in an example.
Figure 27:
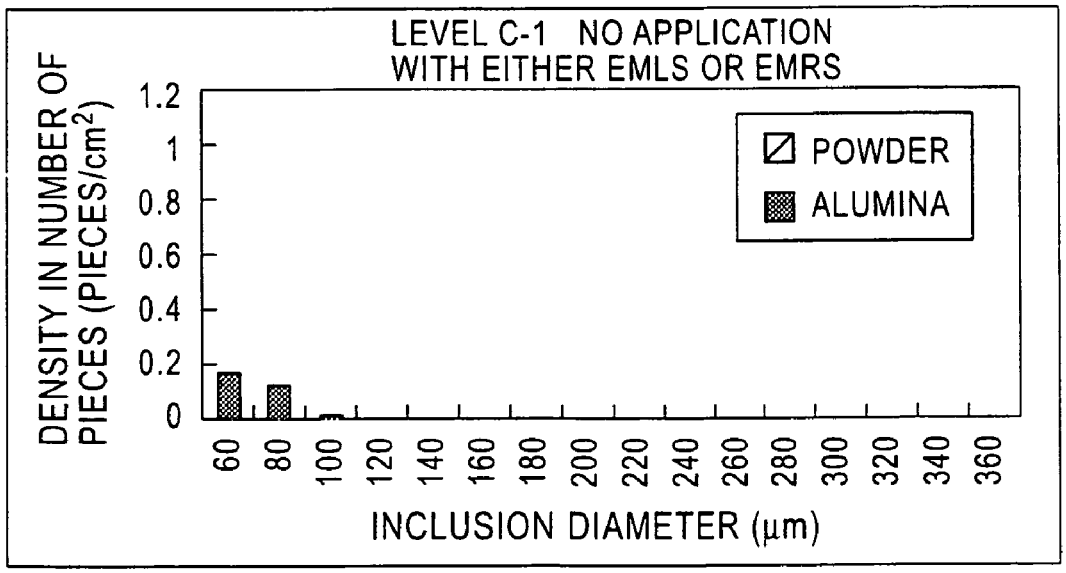
FIG. 27 is a view showing a cast product microscopy result at a level C-1 in an example.
Figure 28:
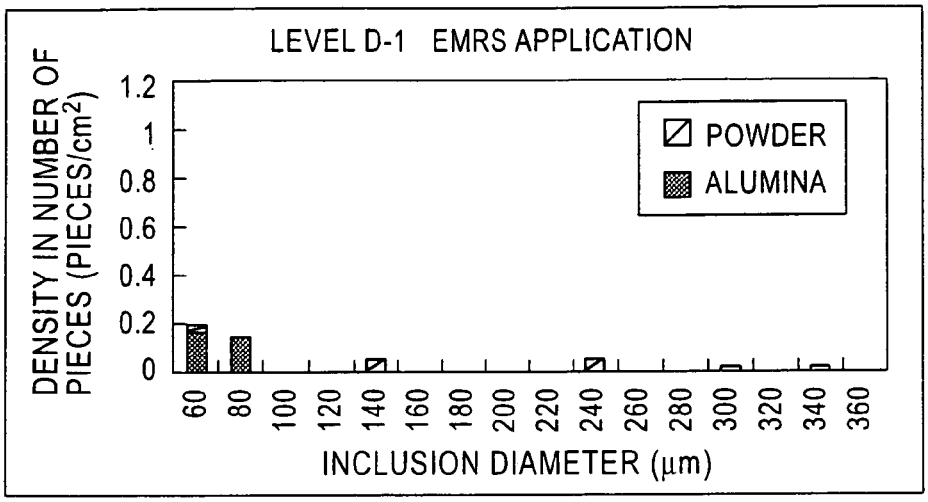
FIG. 28 is a view showing a cast product microscopy result at a level D-1 in an example.
Figure 29:
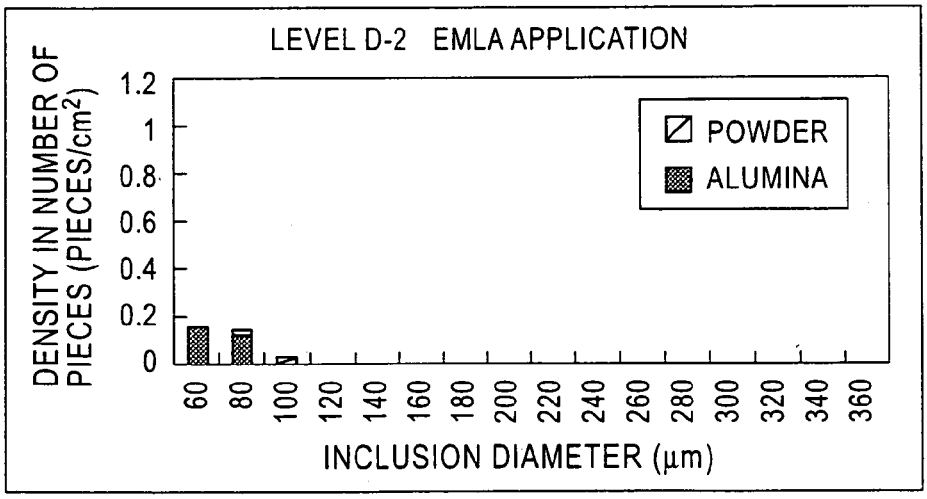
FIG. 29 is a view showing a cast product microscopy result at a level D-2 in an example.
Figure 30:
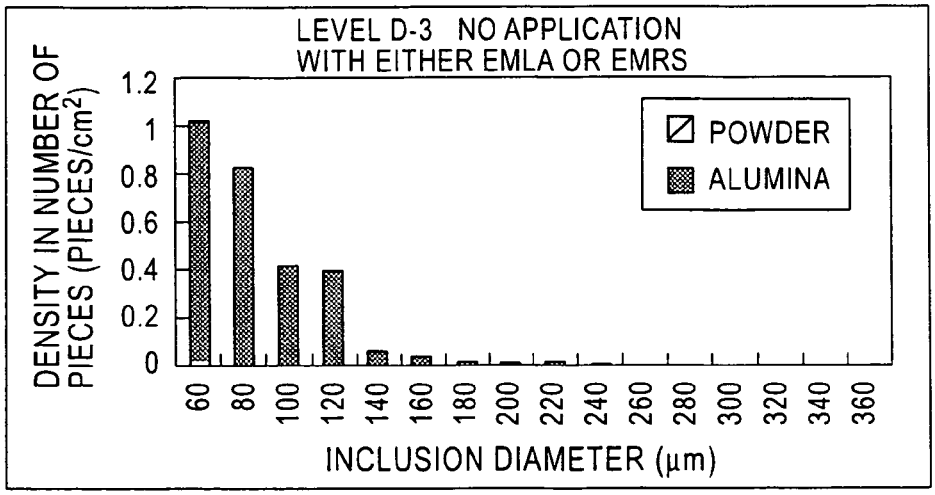
FIG. 30 is a view showing a cast product microscopy result at a level D-3 in an example.

For each of the levels B and D, three cases were provided. The cases are (1) a case where an optimal shifting magnetic field mode and intensity were selected in accordance with the present inventive method (Test Nos. 1, 5, and 10; in this case, the target value of the molten steel flow velocity on the intra-mold molten steel bath surface after the magnetic field application was set to 0.25 m/sec); (2) a case where a shifting magnetic field different from the optimal shifting magnetic field mode (Test Nos. 2, 4, 6, and 9); and (3) a case where no shifting magnetic field was applied (Test Nos. 3, 7, and 11). FIG. 19 is a schematic view created by overlapping the testing conditions of the embodiment with FIG. 18. In the level C (Test No. 18) represents a level in an appropriate range of the molten steel flow velocity on the intra-mold molten steel bath surface, and no shifting magnetic field was applied.

TABLE 5

| | | Cast product | | Casting | | Molten steel flow | Magnetic field | | |
|---|---|---|---|---|---|---|---|---|---|
| Test No. | Test level | Thickness (mm) | Width (mm) | speed (m/min) | F value | velocity (m/s) | Mode | Magnetic flux density (T) | Frequency (Hz) |
| 1 | A-1 | 235 | 1550 | 2.0 | 6.1 | 0.45 | EMLS | 0.09 | 1.0 |
| 2 | A-2 | | | | | | EMRS | 0.10 | 2.6 |
| 3 | A-3 | | | | | | Not applied | — | — |
| 4 | B-1 | 235 | 1550 | 1.0 | 1.5 | 0.10 | EMLS | 0.09 | 1.0 |

TABLE 5-continued

| Test No. | Test level | Cast product Thickness (mm) | Cast product Width (mm) | Casting speed (m/min) | F value | Molten steel flow velocity (m/s) | Magnetic field Mode | Magnetic field Magnetic flux density (T) | Magnetic field Frequency (Hz) |
|---|---|---|---|---|---|---|---|---|---|
| 5 | B-2 | | | | | | EMRS | 0.10 | 2.6 |
| 6 | B-3 | | | | | | EMLA | 0.15 | 1.0 |
| 7 | B-4 | | | | | | Not applied | — | — |
| 8 | C-1 | 235 | 1550 | 1.5 | 3.6 | 0.25 | Not applied | — | — |
| 9 | D-1 | 235 | 1550 | 0.6 | 0.8 | 0.06 | EMRS | 0.10 | 2.6 |
| 10 | D-2 | | | | | | EMLA | 0.15 | 1.0 |
| 11 | D-3 | | | | | | Not applied | — | — |

After the casting, a long-side surface of the cast product was ground 1 mm and then etched, and thereafter, the surface was observed by a microscope to count the number of inclusions having a diameter of 60 μm or greater. In addition, from the color tonality and shape, the inclusions were determined for the difference between types thereof, specifically, deoxidation products (alumina) and mold powder, whereby the numbers of the individual types were counted. A microscopy view was 3600 $mm^2$ per test.

The microscopy results are shown in FIGS. 20 to 30. As shown in these figures, in the level A, in the case of Test No. 1 (level A-1) subjected to the EMLS application, the number of inclusions was smallest, and no inclusions determined as being the mold powder were present. The molten steel flow velocity on the molten steel bath surface is considered to have been controlled by the EMLS to the target value that is lower than or equal to the mold-powder entrainment critical flow velocity. In other two tests (levels A-2 and A-3), inclusions determined as being the mold powder were present, and the sizes thereof are 100 μm or greater. From this, we learned that the probability of causing surface defects such as slivering after rolling is high.

[1] In the level A, in the case of Test No. 5 (level B-1) subjected to the EMRS application, the number of inclusions was smallest. The flow velocity of the solidifying surface is considered to have been sufficiently controlled by the EMLS to the target value that is higher than or equal to the inclusion-adherence critical flow velocity. Also in the case of Test No. 6 (level B-3) subjected to the EMLA application, the number of inclusions was small, and the results were satisfactory, similar to Test No. 5. However, in the case of the EMLA, since the discharge flow was accelerated, when the application intensity was excessively high, the frequency of mold-powder entrainment is increased. As such, the EMLA application intensity should be adjusted, thereby complicating the operation in comparison to the case of EMRS. In the cases of Test No. 4 (level B-1) subjected to the EMLS application and Test No. 7 (level B-4) to which no magnetic field was applied, the solidifying surface flow velocity was considered excessively low, so that the number of inclusions was greatest.

In the level D, in the case of Test No. 10 (level D-1) subjected to the EMLA application, the number of inclusions was smallest. This is considered attributable to the fact that because the molten steel on the intra-mold molten steel bath surface was renewed by the EMLA and the flow velocity on the intra-mold molten steel bath surface was increased thereby, skinning prevention and inclusion adherence prevention were implemented. In the case of Test No. 9 (level D-1), while the total number of inclusions was reduced, there were reserved large mold-powder specific inclusions considered attributable to mold-powder absorption due to skinning. In the case of Test No. 11 (level D-3) to which no magnetic field was applied, the solidifying surface flow velocity was considered excessively low, so that the number of inclusions was great.

In the case of Test No. 8 (level C-1), the molten steel flow velocity on the molten pig iron surface was lower than or equal to the mold-powder entrainment critical flow velocity and concurrently higher than or equal to the inclusion-adherence critical flow velocity. As such, although the condition does not have any of the EMLS, EMRS, and EMLA applications, we learned that the number of inclusions was small.

According to the present invention, a high quality cast with less surface layer inclusions in a wide range of casting speeds can be produced by casting. Consequently, the cast product can be directly rolled without performing preparatory maintenance processing, so that any one of the cast product preparatory maintenance work costs, hot-roll fuel consumption rate, lead time from casting to rolling can be reduced. Thus, the present invention very heavily contributes to the reductions in the manufacturing costs for steel products. Further, the individual magnetic field applications according to the EMLS, EMRS, and EMLA modes can be secured in the single shifting magnetic field generating apparatus by shifting the magnetic field movement direction, so that facility costs required for the magnetic field generators for controlling the molten steel flow can be reduced.

What is claimed is:

1. A method for controlling a flow of a molten steel by applying a shifting magnetic field to the molten steel in a slab continuous casting machine comprising:

controlling a molten steel flow velocity on a molten steel bath surface to a predetermined molten steel flow velocity by applying a shifting magnetic field to impart a braking force to a discharge flow from an immersion nozzle when the molten-steel flow velocity on the molten steel bath surface is higher than a mold-powder entrainment critical flow velocity;

controlling the molten steel flow velocity on the molten steel bath surface to a range of from an inclusion-adherence critical flow velocity or more to a mold-powder entrainment critical flow velocity or less by applying a shifting magnetic field to rotate the molten steel in a horizontal direction when the molten-steel flow velocity on the molten steel bath surface is lower than the inclusion-adherence critical flow velocity and a bath-surface skinning critical flow velocity or more; and controlling the molten steel flow velocity on the molten steel bath surface to the range of from the inclusion-adherence critical flow velocity or more to the mold-powder entrainment critical flow velocity or less by applying a shifting magnetic field to impart an accelerating force to the discharge flow from the immersion nozzle when the molten-steel flow velocity on the molten steel bath surface is lower than the bath-surface skinning critical flow velocity.

2. The method according to claim 1, wherein in applying the shifting magnetic field to rotate the molten steel in the horizontal direction, a magnetic flux density of the shifting magnetic field is determined according to an equation (1) as follows:

$$R=\gamma\cdot B\cdot\sqrt{f} \quad (1)$$

wherein in the equation (1), R is a relative velocity between the molten steel and the magnetic field, γ is a coefficient to be determined per apparatus, B is a magnetic flux density (Tesla), and f is an input current frequency to be input to a shifting magnetic field generating apparatus.

3. The method according to claim 1, wherein in applying the shifting magnetic field to impart the accelerating force to the discharge flow from the immersion nozzle, a magnetic flux density of the shifting magnetic field is determined according to an equation (2) as follows:

$$Av=1+\epsilon\cdot(L-U_0)/U_0^2\cdot B^2 \quad (2)$$

wherein in the equation (2), Av represents a ratio in a case where a positive numeric value represents a flow velocity of the molten steel directed to the side of the immersion nozzle from the side of a mold short side, a negative numeric value represents a flow velocity of the molten steel in the direction opposite thereto, the denominator represents a molten steel surface flow velocity when casting is performed with no shifting magnetic field being applied, and the numerator represents the molten steel surface flow velocity in the event that the shifting magnetic field is applied at a magnetic flux density B; ϵ is a coefficient; L is a moving velocity of the shifting magnetic field; $U_0$ is an average value (m/sec) of linear velocities of molten steel discharge flows along a mold-width direction from an immersion-nozzle discharge opening; and B is a magnetic flux density (Tesla) of the shifting magnetic field.

4. The method according to claim 1, wherein in applying the shifting magnetic field to impart the braking force to the discharge flow from the immersion nozzle, the magnetic flux density of the shifting magnetic field is determined according to an equation (3) as follows:

$$Rv=1-\beta\cdot B^4/V_0 \quad (3)$$

wherein in the Equation (3), Rv represents a ratio in a case where a positive numeric value represents a flow velocity of the molten steel directed to the side of the immersion nozzle from the side of the mold short side, a negative numeric value represents a molten steel flow velocity of the flow in a direction thereto, the denominator represents a molten steel surface flow velocity when casting is performed with no shifting magnetic field being applied, and the numerator represents the molten steel surface flow velocity in the event that the shifting magnetic field is applied at a magnetic flux density B; β is a coefficient; B is the magnetic flux density (Tesla) of the shifting magnetic field; and $V_0$ is the linear velocity (m/sec) of the molten steel discharge flow from the immersion-nozzle discharge opening.

5. The method according to claim 1, wherein the mold-powder entrainment critical flow velocity is 0.32 m/sec; the inclusion-adherence critical flow velocity is 0.20 m/sec; and the bath-surface skinning critical flow velocity is 0.10 m/sec.

6. A method for controlling a flow of a molten steel by applying a shifting magnetic field to the molten steel in a slab continuous casting machine, the method comprising:

applying a shifting magnetic field to impart a braking force to a discharge flow from an immersion nozzle when a molten-steel flow velocity on a molten steel bath surface is higher than an optimal flow velocity value at which mold-powder entrainment is minimized and inclusion adherence to a solidifying shell is minimized;

applying a shifting magnetic field to rotate the molten steel in a horizontal direction when the molten-steel flow velocity on the molten steel bath surface is lower than the optimal flow velocity value and is higher than or equal to a bath-surface skinning critical flow velocity; and applying the molten steel flow velocity on the molten steel bath surface to impart an accelerating force to the discharge flow from the immersion nozzle when the molten-steel flow velocity on the molten steel bath surface is lower than the bath-surface skinning critical flow velocity.

7. The method according to claim 6, wherein the optimal flow velocity value is 0.25 m/sec, and the bath-surface skinning critical flow velocity is 0.10 m/sec.

8. The method according to claims 1 or 6, wherein in the event of applying the shifting magnetic field to control the molten steel flow velocity on the molten steel bath surface to impart the braking force to the discharge flow from the immersion nozzle, when a positive numeric value represents a flow velocity of the molten steel directed to the side of the immersion nozzle from the side of the mold short side and a negative numeric value represents the molten steel flow velocity of the flow in the direction opposite thereto, the molten steel flow velocity on the molten steel bath surface in a cast product thickness-wise central position spaced apart by a distance of ¼ of the mold width from the immersion nozzle toward the side of the mold short side is controlled to fall within a range of from −0.07 m/sec to 0.05 m/sec.

9. The method according to claims 1 or 6, wherein when applying the shifting magnetic field, the method predicts the molten steel flow velocity on the molten steel bath surface in a state where no magnetic field is applied according to an equation (4) set forth hereinbelow, and applies a predetermined shifting magnetic field in accordance with a predicted molten steel flow velocity:

$$u=k\cdot\rho\cdot Q_L\cdot Ve((1-\sin\theta)/2)\cdot(1/D) \quad (4)$$

wherein in the equation (4), u is the molten steel flow velocity on the molten steel bath surface, that is, the molten steel surface flow velocity (m/sec); k is a coefficient; p is a density of the molten steel (kg/m$^3$); $Q_L$ is a molten steel pouring volume (m$^3$/sec); Ve is a velocity of the molten steel discharge flow when impinging on the mold-short-side surface side (m/sec); θ is an angle (deg) of the molten steel discharge flow with respect to horizontality in a position where the molten steel discharge flow impinges on the mold-short-side surface side; and D is a distance (m) to the molten steel bath surface from the position at which the molten steel discharge flow impinges on the mold-short-side surface side.

10. The method according to claim 9, wherein molten steel flow velocities on the molten steel bath surface are repeatedly predicted by using the equation (4) during casting, and predetermined shifting magnetic fields are serially applied in accordance with the predicted molten steel flow velocities.

11. A method for controlling a flow of a molten steel in a mold by applying a shifting magnetic field to the molten steel in a slab continuous casting machine, the method comprising:

applying a shifting magnetic field to impart a braking force to a discharge flow from an immersion nozzle when an F value shown in an equation (5) set forth hereinbelow that is obtainable from casting conditions is higher than a mold-powder entrainment critical F value;

applying a shifting magnetic field to rotate the molten steel in a horizontal direction when the F value is lower than an inclusion-adherence critical F value and is higher than or equal to a bath-surface skinning critical F value; and applying a shifting magnetic field to impart an accelerating force to a discharge flow from an immersion nozzle when the F value is lower than the bath-surface skinning critical F value:

$$F\ \text{value}=\rho\cdot Q_L\cdot Ve\cdot((1-\sin\theta)/4)\cdot(1/D) \quad (5)$$

wherein in the equation (5), ρ is a density of the molten steel (kg/m$^3$); $Q_L$ is a molten steel pouring volume (m$^3$/sec); Ve is a velocity of the molten steel discharge flow when impinging on the mold-short-side surface side (m/sec); θ is an angle (deg) of the molten steel discharge flow with respect to horizontality in a position where the molten steel discharge flow impinges on the mold-short-side surface side; and D is a distance (m) to the molten steel bath surface from the position at which the molten steel discharge flow impinges on the mold-short-side surface side.

12. The method according to claim 11, wherein in applying the shifting magnetic field to rotate the molten steel in the horizontal direction, a magnetic flux density of the shifting magnetic field is determined according to an equation (1) as follows:

$$R=\gamma\cdot B\cdot\sqrt{f} \quad (1)$$

wherein in the equation (1), R is a relative velocity between the molten steel and the magnetic field, γ is a coefficient to be determined per apparatus, B is a magnetic flux density (Tesla), and f is an input current frequency to be input to a shifting magnetic field generating apparatus.

13. The method according to claim 11, wherein in applying the shifting magnetic field to impart the accelerating force to the discharge flow from the immersion nozzle, a magnetic flux density of the shifting magnetic field is determined according to an equation (2) as follows:

$$Av=1+\epsilon\cdot(L-U_0)/U_0^2\cdot B^2 \quad (2)$$

wherein in the equation (2), Av represents a ratio in a case where a positive numeric value represents a flow velocity of the molten steel directed to the side of the immersion nozzle from the side of a mold short side, a negative numeric value represents a flow velocity of the molten steel in the direction opposite thereto, the denominator represents a molten steel surface flow velocity when casting is performed with no shifting magnetic field being applied, and the numerator represents the molten steel surface flow velocity in the event that the shifting magnetic field is applied at a magnetic flux density B; ϵ is a coefficient; L is a moving velocity of the shifting magnetic field; $U_0$ is an average value (m/sec) of linear velocities of molten steel discharge flows along a mold-width direction from an immersion-nozzle discharge opening; and B is a magnetic flux density (Tesla) of the shifting magnetic field.

14. The method according to claim 11, wherein in applying the shifting magnetic field to impart the braking force to the discharge flow from the immersion nozzle, the magnetic flux density of the shifting magnetic field is determined according to an equation (3) as follows:

$$Rv=1-\beta\cdot B^4/V_0 \quad (3)$$

wherein in the equation (3), Rv represents a ratio in a case where a positive numeric value represents a flow velocity of the molten steel directed to the side of the immersion nozzle from the side of the mold short side, a negative numeric value represents a flow velocity of the molten steel in the direction opposite thereto, the denominator represents a molten steel surface flow velocity when casting is performed with no shifting magnetic field being applied, and the numerator represents the molten steel surface flow velocity in the event that the shifting magnetic field is applied at a magnetic flux density B; β is a coefficient; B is the magnetic flux density (Tesla) of the shifting magnetic field; and $V_0$ is the linear velocity (m/sec) of the molten steel discharge flow from the immersion-nozzle discharge opening.

15. The method according to claim 11, wherein the mold-powder entrainment critical F value is 4.3, the inclusion-adherence critical F value is 2.7, and the bath-surface skinning critical F value is 1.4.

16. A method for controlling a flow of a molten steel in a mold by applying a shifting magnetic field to the molten steel in a slab continuous casting machine, the method comprising:

applying a shifting magnetic field to impart a braking force to a discharge flow from an immersion nozzle when an F value shown in an equation (5) set forth hereinbelow that is obtained from casting conditions is higher than an optimal F value at which mold-powder entrainment is minimized and inclusion adherence to a solidifying shell is minimized;

applying a shifting magnetic field to rotate the molten steel in a horizontal direction when the F value is lower than the optimal F value and is higher than or equal to a bath-surface skinning critical F value; and applying a shifting magnetic field to impart an accelerating force to the discharge flow from the immersion nozzle when the F value is lower than the bath-surface skinning critical F value:

$$F\ \text{value}=\rho\cdot Q_L\cdot Ve\cdot((1-\sin\theta)/4)\cdot(1/D) \quad (5)$$

wherein in the equation (5), ρ is a density of the molten steel (kg/m$^3$); $Q_L$ is a molten steel pouring volume (m$^3$/sec); Ve is a velocity of the molten steel discharge flow when impinging on the mold-short-side surface side (m/sec); θ is an angle (deg) of the molten steel discharge flow with respect to horizontality in a position where the molten steel discharge flow impinges on the mold-short-side surface side; and D is a distance (m) to the molten steel bath surface from the position at which the molten steel discharge flow impinges on the mold-short-side surface side.

17. The method according to claim 16, wherein the optimal F value is 3.4, and the bath-surface skinning critical F value is 1.4.

18. The method according to claims 11 or 16, wherein the event of applying the shifting magnetic field to control the molten steel flow velocity on the molten steel bath surface to impart the braking force to the discharge flow from the immersion nozzle, when a positive numeric value represents a flow velocity of the molten steel directed to the side of the immersion nozzle from the side of the mold short side and a negative numeric value represents the molten steel flow velocity of the flow in the direction opposite thereto, the molten steel flow velocity on the molten steel bath surface in a cast product thickness-wise central position spaced apart by a distance of ¼ of the mold width from the immersion nozzle toward the side of the mold short side is controlled to fall within a range of from −0.07 m/sec to 0.05 m/sec.

19. The method according to claims 11 or 16, wherein the F values are repeatedly calculated by using Equation (5) during casting, and predetermined shifting magnetic fields are serially applied in accordance with the calculated F values.

20. A method for controlling a flow of a molten steel in a mold comprising:

a first step of acquiring at least five conditions as casting conditions on a cast product thickness, a cast product width, a casting speed, an amount of inert gas injection into a molten steel outflow opening nozzle, and an immersion nozzle shape;

a second step of calculating a molten steel flow velocity on a molten steel bath surface in accordance with the acquired casting conditions;

a third step of determining whether the acquired molten steel flow velocity is higher than a mold-powder entrainment critical flow velocity, whether the molten steel flow velocity is lower than an inclusion-adherence critical flow velocity, and whether the molten steel flow velocity is lower than a bath-surface skinning critical flow velocity by comparing the acquired molten steel flow velocity with the mold-powder entrainment critical flow velocity, the inclusion-adherence critical flow velocity, and the bath-surface skinning critical flow velocity; and a fourth step of applying a shifting magnetic field to impart a braking force to a discharge flow from an immersion nozzle when the acquired molten steel flow velocity is higher than the mold-powder entrainment critical flow velocity, applying a shifting magnetic field to rotate the intra-mold molten steel in a horizontal direction when the acquired molten steel flow velocity is lower than the inclusion-adherence critical flow velocity and is higher than or equal to the bath-surface skinning critical flow velocity, and applying a shifting magnetic field to impart an accelerating force to a discharge flow from an immersion nozzle, wherein the flow of the molten steel is controlled by applying a predetermined shifting magnetic field to the molten steel in a slab continuous casting machine.

21. The method according to claim 20, wherein the first to fourth steps are repeatedly executed during casting, and an optimal shifting magnetic field is applied in response to casting conditions during the execution.

22. A method for producing a cast product in a continuous casting machine, wherein during the execution of a molten steel flow control in accordance with the method for controlling a flow of a molten steel according to claims 1, 6, 11 or 16, molten steel in a tundish is poured into a mold, and a slab is manufactured by withdrawing a solidified shell generated in a mold.

* * * * *